US008861313B2

(12) United States Patent
Suzuki et al.

(10) Patent No.: US 8,861,313 B2
(45) Date of Patent: Oct. 14, 2014

(54) CALENDAR MECHANISM AND TIMEPIECE HAVING THE SAME

(75) Inventors: Shigeo Suzuki, Chiba (JP); Mamoru Watanabe, Chiba (JP)

(73) Assignee: Seiko Instruments Inc. (JP)

( * ) Notice: Subject to any disclaimer, the term of this patent is extended or adjusted under 35 U.S.C. 154(b) by 321 days.

(21) Appl. No.: 13/473,842

(22) Filed: May 17, 2012

(65) Prior Publication Data

US 2012/0314544 A1 Dec. 13, 2012

(30) Foreign Application Priority Data

Jun. 10, 2011 (JP) ..... 2011-130168

(51) Int. Cl.
*G04B 19/20* (2006.01)
*G04B 19/24* (2006.01)
*G04B 19/253* (2006.01)

(52) U.S. Cl.
CPC ..... *G04B 19/2538* (2013.01)
USPC ..... 368/37

(58) Field of Classification Search
USPC ..... 368/28, 31–38
See application file for complete search history.

(56) References Cited

U.S. PATENT DOCUMENTS

| | | | | |
|---|---|---|---|---|
| 203,640 | A * | 5/1878 | Paddock | 368/31 |
| 3,716,983 | A * | 2/1973 | Tanaka et al. | 368/28 |
| 3,841,084 | A * | 10/1974 | Eumier | 368/37 |
| 6,108,278 | A * | 8/2000 | Rochat | 368/28 |
| 8,059,492 | B2 | 11/2011 | Watanabe | 368/37 |
| 2009/0129207 | A1 * | 5/2009 | Watanabe | 368/37 |
| 2010/0188937 | A1 * | 7/2010 | Watanabe | 368/37 |

FOREIGN PATENT DOCUMENTS

| | | |
|---|---|---|
| JP | 63313089 | 12/1988 |
| JP | 2005326420 | 11/2005 |

OTHER PUBLICATIONS

Patent Abstracts of Japan, publication No. 2009-128119, publication date Nov. 6, 2009.

* cited by examiner

*Primary Examiner* — Sean Kayes
(74) *Attorney, Agent, or Firm* — Adams & Wilks

(57) ABSTRACT

A calendar mechanism of a timepiece includes a date indicator having a date wheel portion provided with a notched portion. An operation lever attached to the date indicator is pivotable between a pre-feed allowing position, where a tooth-shaped engaged portion thereof is inserted into the notched portion whereby excess feeding of the date indicator is possible, and a normal feed allowing position, where the tooth-shaped engaged portion retreats from the notched portion whereby normal feeding is possible. The date indicator is rotated by a day earlier than the normal feeding when set to the pre-feed allowing position. A driving lever structure includes a cam follower engaged with a month cam and is driven in response to rotation of the month cam to allow the operation lever to be pivoted between the normal feed allowing position and the pre-feed allowing position.

10 Claims, 23 Drawing Sheets

CALENDAR MECHANISM AND TIMEPIECE HAVING THE SAME

BACKGROUND OF THE INVENTION

1. Field of the Invention

The present invention relates to a calendar mechanism and a timepiece having the same.

2. Description of the Related Art

A variety of techniques are known as techniques taking a form of a so-called automatic calendar mechanism which discriminates between a long month (a month with 31 days) and a short month (a month with 30 days or less) and performs month feeding as the calendar mechanism.

In the automatic calendar mechanism, a date is fed by an amount of two days at the end of the month (30-th date) in the short month other than February, and, for it, a variety of mechanisms have been proposed (Japanese Patent No. 2651150 (Patent Reference 1) or JP-A-2005-326420 (Patent Reference 2)).

In a calendar mechanism of Japanese Patent No. 2651150 (Patent Reference 1), a month cam for discriminating a long month and a short month is used, but an elastic arm portion of the date feed finger is forced to be deformed and is fed at one tooth a day in a normal state (dates other than an end of the short month), and stability of the operation of the date feed finger is easily damaged. In addition, a Zala load (a load related to the rotation of the wheel train) is easily increased structurally, and then a loss in energy is easily increased. In addition, using the month cam itself is widely known (for example, JP-A-2009-128119 (Patent Reference 3) in addition to Japanese Patent No. 2651150 (Patent Reference 1)).

In a calendar mechanism of JP-A-2009-128119 (Patent Reference 2), an additional mechanism may be attached to a date indicator, but a helical wheel mechanism at which the number of teeth is set to operate in a predetermined manner is used, and a structure thereof may be very complicated.

SUMMARY OF THE INVENTION

The present invention has been made in consideration of the various problems, and is to provide a calendar mechanism and a timepiece with calendar mechanism having the same, capable of preventing complexity of a structure and effectively performing month and date indication, by providing a month cam and providing at a date indicator a lever having a tooth-shaped finger portion (tooth-shaped engaged portion) related to date feeding in the same manner as teeth of a date wheel so as to progress and retreat.

In order to achieve the object, there is provided a calendar mechanism including a date indicator that includes a date wheel portion provided with a notched portion extending in a diameter direction; an operation lever that is attached to the date indicator so as to be pivoted with respect to a date wheel and is provided at one end with a tooth-shaped engaged portion and can progress and retreat to and from the notched portion formed at the date indicator when pivoted, wherein the operation lever can be pivoted between a pre-feed allowing position where the tooth-shaped engaged portion is deeply inserted into the notched portion and is engaged with a date finger, and thereby excess feeding of the date indicator is possible, and a normal feed allowing position where the tooth-shaped engaged portion retreats further from the notched portion than the pre-feed allowing position and thus normal feeding is possible by the date finger, and the date finger is engaged with the tooth-shaped engaged portion before the timing of the normal feeding and rotates the date indicator by an excess day earlier than the normal feeding when set to the pre-feed allowing position; a month cam that is rotated according to rotation of a month indication wheel and has a cam face indicating long months and short months; and a driving lever structure that includes a cam follower engaged with the month cam and is driven in response to rotation of the month cam so as to allow the operation lever to be pivoted between the normal feed allowing position and the pre-feed allowing position, wherein the driving lever structure allows the operation lever to be displaced to the pre-feed allowing position when a month is changed from the short month to the long month.

In the calendar mechanism of the present invention, there are provided "an operation lever that is attached to the date indicator so as to be pivoted with respect to a date wheel and is provided at one end with a tooth-shaped engaged portion and can progress and retreat to and from the notched portion formed at the date indicator when pivoted, wherein the operation lever can be pivoted between a pre-feed allowing position where the tooth-shaped engaged portion is deeply inserted into the notched portion and is engaged with a date finger, and thereby excess feeding of the date indicator is possible, and a normal feed allowing position where the tooth-shaped engaged portion retreats further from the notched portion than the pre-feed allowing position and thus normal feeding is possible by the date finger, and the date finger is engaged with the tooth-shaped engaged portion before the timing of the normal feeding and rotates the date indicator by an excess day earlier than the normal feeding when set to the pre-feed allowing position; and a driving lever structure that includes a cam follower engaged with the month cam and is driven in response to rotation of the month cam so as to allow the operation lever to be pivoted between the normal feed allowing position and the pre-feed allowing position", and thus the driving lever structure is driven by the month cam such that the operation lever is allowed to be displaced to the pre-feed allowing position by the driving lever structure. Therefore, when a month is changed from a short month to a long month, the date finger is engaged with the tooth-shaped engaged portion before the timing of the normal feeding and rotates the date indicator by an excess day earlier than the normal feeding. Accordingly, month changing from a short month to a long month can be automatically performed.

In addition, in the calendar mechanism of the present invention, the date indicator "includes a date wheel portion provided with a notched portion extending in a diameter direction", "the operation lever is attached to the date indicator so as to be pivoted with respect to a date wheel", and the operation lever includes the tooth-shaped engaged portion which is operated in the same manner as teeth of the date wheel (however, so as to be the same as it in some cases or different from it in other cases), whereby month and date indication can be performed efficiently while preventing complexity of the structure.

In the calendar mechanism according to an aspect of the present invention, the date wheel may include a notched portion between adjacent tooth portions, and the operation lever can be pivoted between a pre-feed allowing position where the tooth-shaped engaged portion enters the notched portion and a normal feed allowing position where the tooth-shaped engaged portion retreats from the notched portion and becomes distant from the date finger, and thereby normal feeding is possible, and when a month is changed from the short month to the long month, the operation lever may take the pre-feed allowing position where the tooth-shaped engaged portion enters the notched portion, and the date finger may be engaged with the tooth-shaped engaged portion before the timing of the normal feeding and rotates the date indicator by an excess day earlier than the normal feeding.

In this case, since the notched portion is formed between the adjacent tooth portions of the date wheel, the tooth-shaped engaged portion inserted into the notched portion is engaged with the tooth-shaped engaged portion before the timing of the normal feeding and can rotate the date indicator earlier than the normal feeding. Here, since a rotation position of the date wheel is jumped by the date jumper, the date finger is engaged with the tooth-shaped engaged portion before the normal feeding and is rotated before the normal feeding, thereafter the date indicator is set to a predetermined position by a function of the date jumper, further date feeding is performed, and the date indicator is rotated with a spare by a day. In addition, in this case, since date feeding is twice performed for a short time, date feeding corresponding to two days is performed at night of the month end (30-th date) in a short month so as to suppress a sense of discomfort to the minimum.

In this case, in the calendar mechanism according to the present invention, typically, when the operation lever takes the pre-feed allowing position, the tooth-shaped engaged portion is projected inward in the diameter direction to the same extent as a tooth portion forming the date wheel, and when the operation lever takes the normal feed allowing position, the tooth-shaped engaged portion retreats outward in the diameter direction from the notched portion so as to be located further outward in the diameter direction than the tooth portion forming the date wheel.

In this case, since the notched portion is preferably formed between teeth of the date wheel, it can be relatively easily formed. In addition, by forming the notched portion not at the middle of the adjacent teeth but at a different circumferential direction position, or changing a projection length of the tooth-shaped engaged portion, it is possible to change timing of a first date change of two date changes when a short month transitions to a long month.

In the calendar mechanism according to another aspect of the present invention, the date wheel may include a groove-shaped notched portion that radially extends along one tooth portion at a position in the circumferential direction which overlaps one tooth portion, and, when a month is changed from the short month to the long month, the tooth-shaped engaged portion of the operation lever may enter the groove-shaped notched portion, and the date indicator may rotated with a spare by a day.

In this case, since the notched portion is preferably formed at the circumferential direction position overlapping the tooth portions of the date wheel, an interval between the tooth portions forming the date wheel may be small.

In this case, in the calendar mechanism of the present invention, typically, when the operation lever takes the pre-feed allowing position, the tooth-shaped engaged portion is projected further inward in the diameter direction than the tooth portion forming the date wheel, and when the operation lever takes the normal feed allowing position, the tooth-shaped engaged portion retreats outward in the diameter direction from the notched portion so as to be located further outward in the diameter direction than the tooth portion forming the date wheel.

In this case, by changing the projection length of the tooth-shaped engaged portion from the notched portion, it is possible to change timing of a first date change of two date changes when a short month transitions to a long month.

In the calendar mechanism according to still another aspect of the present invention, one tooth portion of thirty-one tooth portions which are disposed at the same interval and form the date wheel may be omitted so as to form the notched portion, and, when a month is changed from the short month to the long month, the tooth-shaped engaged portion of the operation lever may enter the groove-shaped notched portion, and the date indicator may be rotated with a spare by a day.

In this case, since the notched portion is preferably formed at a place where the tooth portion is originally located, it is possible to suppress influence which the formation of the notched portion exerts on other portions to the minimum.

In the calendar mechanism of the present invention, typically, when the operation lever takes the pre-feed allowing position, the tooth-shaped engaged portion is projected further inward in the diameter direction than the tooth portions forming the date wheel, and when the operation lever takes the normal feed allowing position, the tooth-shaped engaged portion retreats outward in the diameter direction from the notched portion as compared with the case of being located at the pre-feed allowing position so as to be projected inward in the diameter direction to the same extent as the tooth portions forming the date wheel.

In this case as well, by changing the projection length of the tooth-shaped engaged portion from the notched portion, it is possible to change timing of a first date change of two date changes when a short month transitions to a long month. In addition, in this case, even at the normal feed allowing position, the tooth-shaped engaged portion contributes to the date feeding in the same manner as the typical tooth portions of the date wheel, and it is possible to use the tooth-shaped engaged portion to the maximum.

In the calendar mechanism of the present invention, typically, the driving lever structure includes a first driving lever that is rotated by the month cam, and a second driving lever that is rotated by the rotation of the first driving lever and controls pivoting of the operation lever.

In this case, the month cam is effectively easily connected to the operation lever. However, other structures may be used.

In the calendar mechanism of the present invention, typically, the operation lever is configured to enter the pre-feed allowing position when time reaches an end of the month, at a pivot position which the operation lever takes such that the operation lever takes the pre-feed allowing position at the end of the month of the short month, and the tooth-shaped engaged portion of the operation lever enters the notched portion.

In this case, attachment to the operation lever can be maximally used. In addition, a relative positional relationship between the operation lever and the driving lever structure at a time point close to an end of the month is set by a position or a shape of a side surface portion (an outer surface in shown examples described later) of the operation lever, and, alternatively, may be set by a shape of a portion interfering with the operation lever in the driving lever structure (a second driving lever in shown examples described later) (in shown examples described later, a pin-shaped pressing portion of the second driving lever may have a shape which is varied in the circumferential direction).

A timepiece with calendar mechanism of the present invention includes the above-described calendar mechanism in order to achieve the object.

DETAILED DESCRIPTION OF THE PREFERRED EMBODIMENTS

Several preferred embodiments of the present invention will be described based on the preferred embodiments shown in the accompanying drawings.

[Embodiments]

FIGS. 1 to 16 show a timepiece having an automatic calendar mechanism 1 according to a preferred embodiment of the present invention, that is, a timepiece with calendar mechanism 2.

Figure 1:
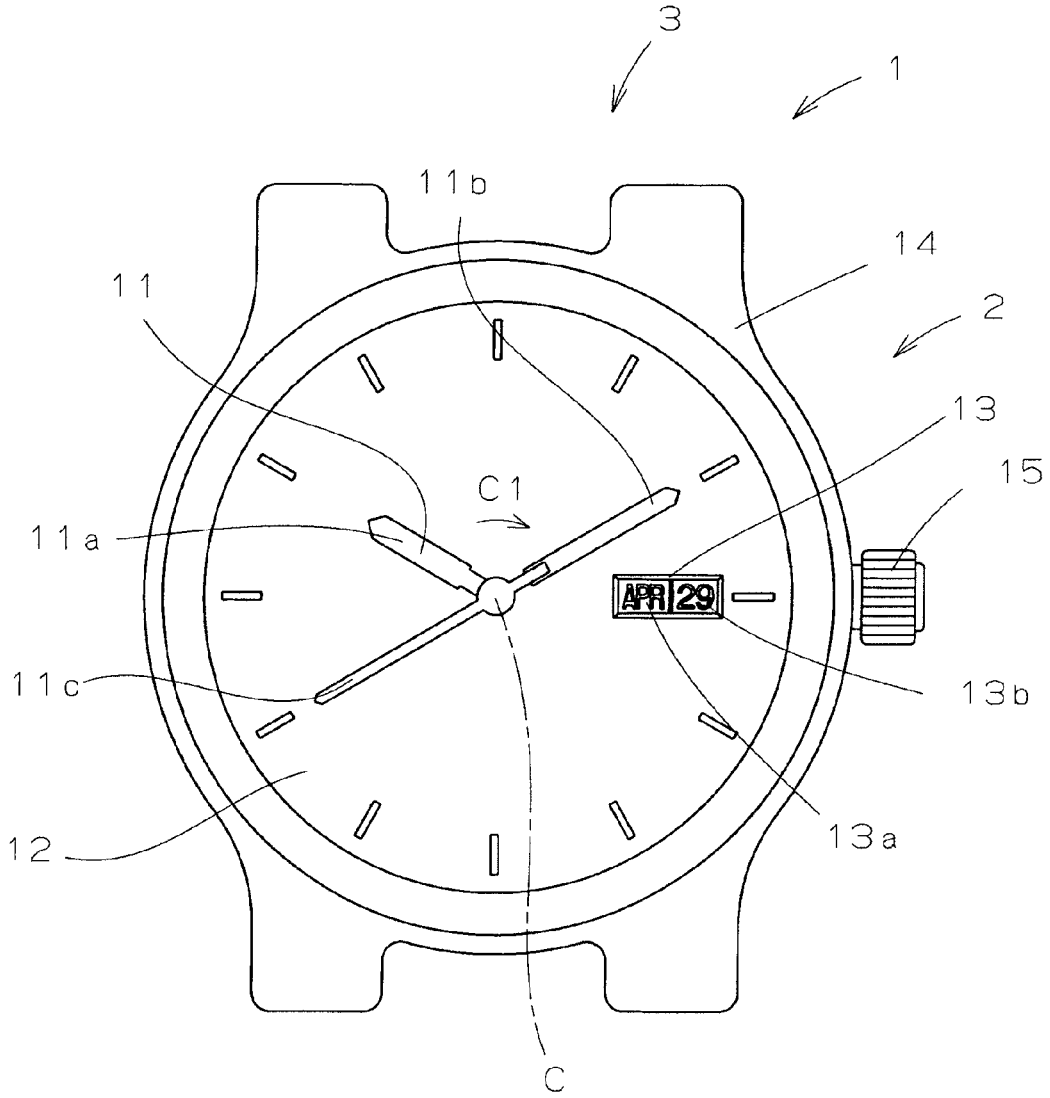
FIG. 1 is a diagram illustrating an exterior of a timepiece with calendar mechanism according to a preferred embodiment of the present invention having an automatic calendar mechanism according to a preferred embodiment of the present invention.

The timepiece with calendar mechanism 2 has an exterior 3 as shown in FIG. 1. That is to say, the timepiece with calendar mechanism 2 is provided time indication hands 11 formed from an hour hand 11*a*, a minute hand 11*b*, and a second hand 11*c* so as to be rotatable in the clockwise rotation C1 around a central axis line C. A dial 12 of the timepiece with calendar mechanism 2 includes a month and date indication window 13 having a month indication region 13*a* and a date indication region 13*b*. The reference numeral 14 denotes a timepiece case, and the reference numeral 15 denotes a crown.

Figure 4:
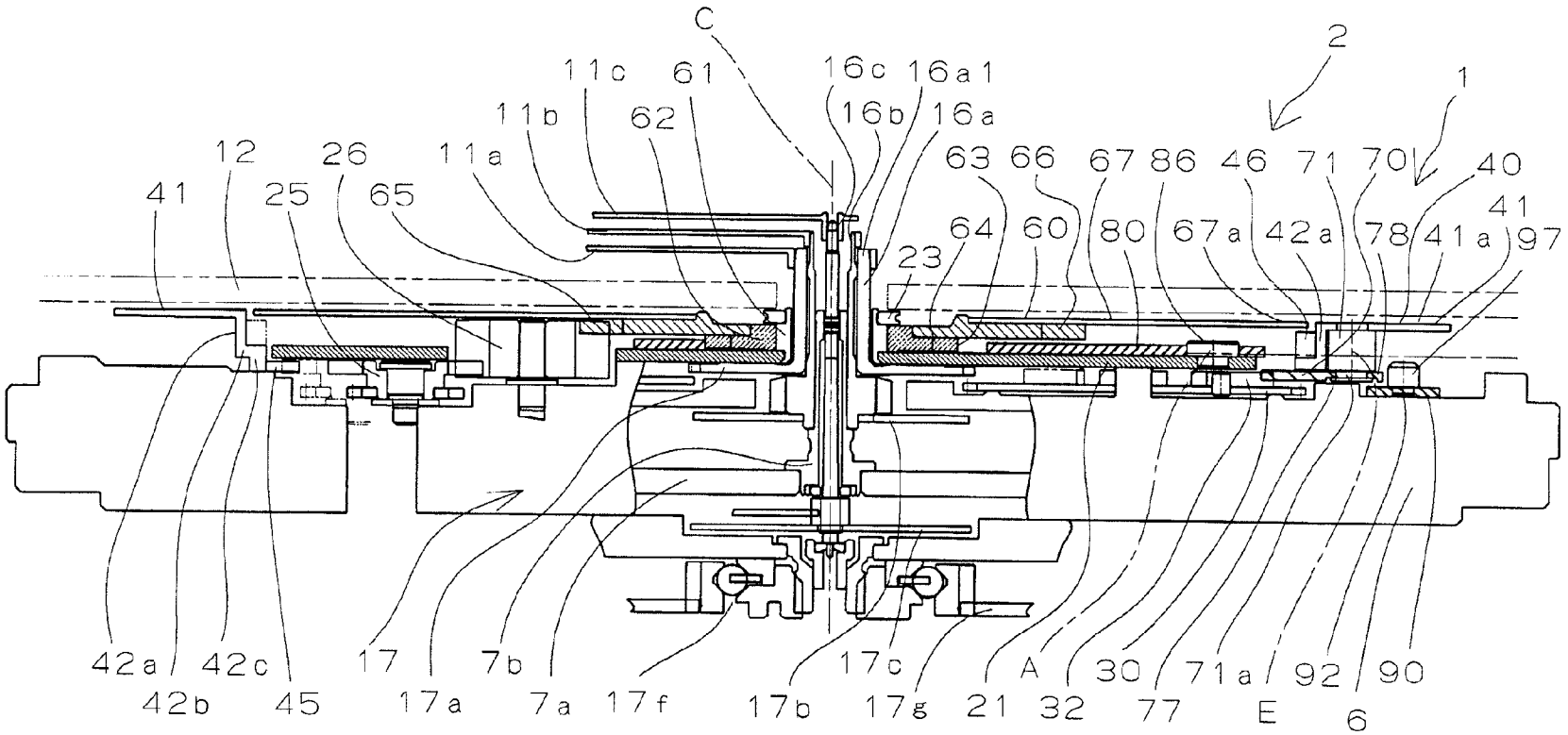
FIG. 4 is a cross-sectional view of the timepiece shown in FIG. 1.

In the example shown in FIG. 4, an hour wheel & pinion 16*a* in which the hour hand 11*a* is attached to a front end thereof, a minute wheel & pinion 16*b* in which the minute hand 11*b* is attached a front end thereof, and a second wheel & pinion or a fourth wheel & pinion 16*c* in which the second hand 11*c* is attached to a front end thereof are rotatably supported around the central axis line C via a center pipe 7*b* which is supported by a main plate 6 or a center wheel bridge 7*a*, and are rotated by hand operation wheel trains 17 which connect a wheel portion or an hour wheel 17*a* of the hour wheel & pinion 16*a*, a minute wheel or a center wheel 17*b* of the minute wheel & pinion 16*b*, and a wheel portion or a second wheel 17*c* of the fourth wheel & pinion 16*c* to each other and includes other wheel trains connecting them to a driving source (not shown) such as a barrel drum having a timepiece mainspring. The reference numeral 17*f* denotes a ball bearing portion supporting an oscillating weight 17*g* for automatically winding the mainspring.

Figure 2:
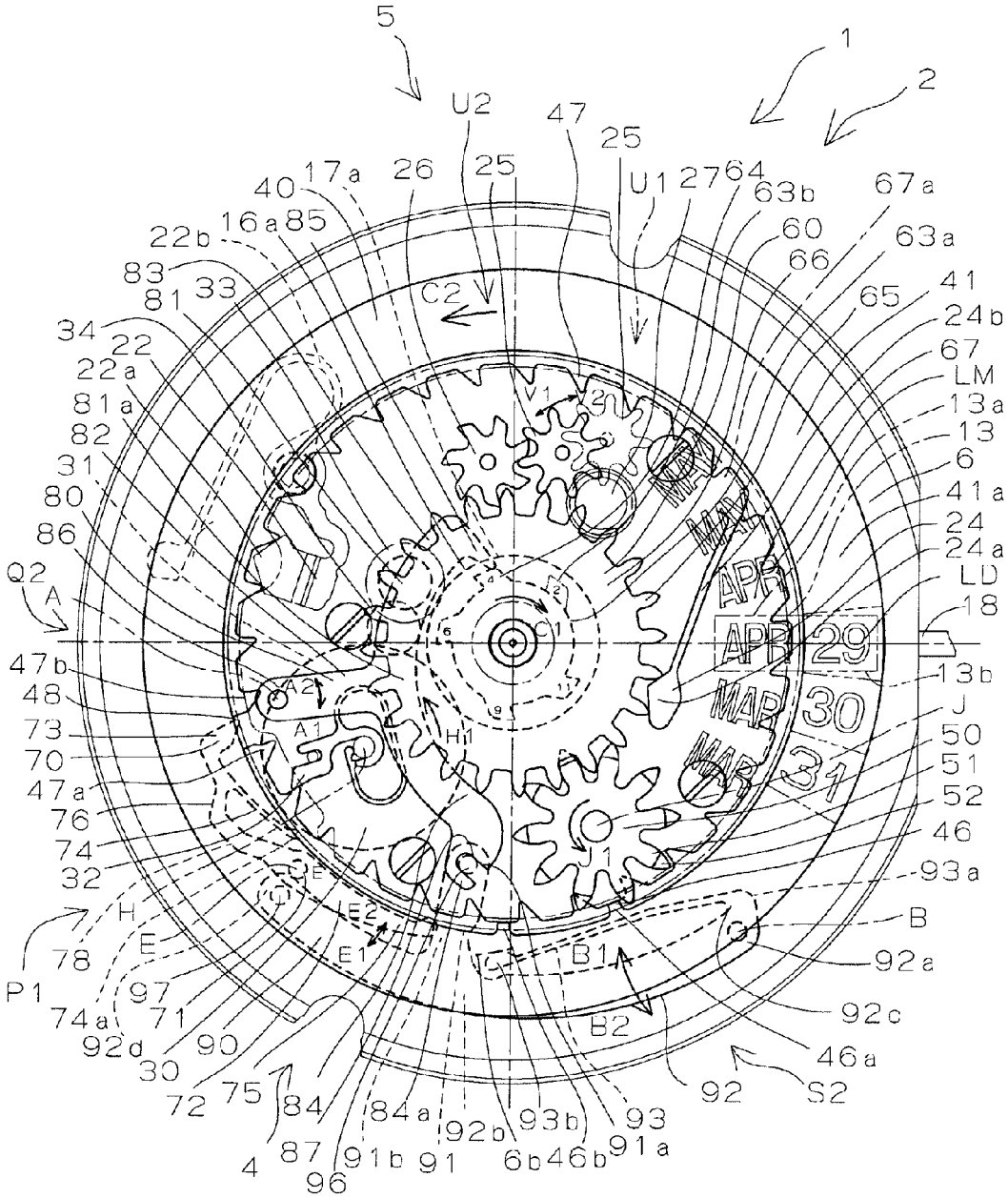
FIG. 2 is a plan view of the timepiece with calendar mechanism shown in FIG. 1 (state where a dial or time indication hands are removed).

As shown in FIG. 2, a date indicator driving wheel 30 meshes with the hour wheel 17*a* of the hour wheel & pinion 16*a* by a date indicator driving wheel portion 31 via first and second intermediate date wheels 33 and 34, and is rotated at a speed of one rotation/day in an H1 direction around a central axis line H, thereby intermittently rotating a data indicator 40 by a date finger 32 in the counterclockwise rotation C2.

As can be seen from FIG. 4 along with FIG. 2, the date indicator 40 includes a date indication wheel portion 41 having a large diameter and a flat ring shape, a large-diameter cylindrical portion 42*a* which extends in parallel in the axis line from the inner edge of the date indication wheel portion 41, a flange-shaped portion 42*b* which extends inward in the diameter direction from the lower end of the large-diameter cylindrical portion 42*a*, a small-diameter and thick cylindrical portion 42*c* which extends in parallel in the axis line direction from the inner edge of the flange-shaped portion 42*b*, a date wheel portion 45 which is formed at the inner circumferential edge on the lower side of the small-diameter and thick cylindrical portion 42*c*, and a month feed tooth portion 46 which is formed at the inner circumferential edge of the large-diameter cylindrical portion 42*a*.

The month feed tooth portion 46 includes two tooth portions 46*a* and 46*b*. Characters LD indicating thirty-one dates from 1 to 31 are displayed at the surface 41*a* on the dial side of the date indication wheel portion 41 at the same interval. The date wheel portion 45 includes thirty-one tooth portions 47 provided at the same interval. In this example, a notched portion 48 is provided between specific tooth portions 47*a* and 47*b* which are adjacent to each other. The notched portion 48 has a width in the circumferential direction which is substantially the same as that of the tooth portions 47. C2 direction rotation of the date indicator 40 is set by a date jumper 22 including a date jumper finger portion 22*a* and a date jumper spring portion 22*b*. As can be seen from FIGS. 4 to 6, a position shift in the thickness of the date indicator 40 is set by a date indicator maintaining plate 21 attached to the main plate 6 so as to cover the date wheel portion 45.

The month feed tooth portion 46 of the date indicator 40 rotates a month indicator 60 around the central axis line C in the C1 direction via a month transmission wheel 50.

As can be seen from FIG. 2, the month transmission wheel 50 is formed a wheel 51 which is freely rotated around the central axis line J, and teeth 52 of the wheel 51 is rotated by one tooth in the J1 direction by each of the tooth portions 46*a* and 46*b* when engaged with the tooth portions 46*a* and 46*b* of the month feed tooth portion 46 of the date indicator 40. In this example, since the month feed tooth portion 46 includes two tooth portions 46*a* and 46*b*, the month transmission wheel 50 is rotated by two teeth in the J1 direction in January.

As can be seen from the cross-sectional view such as FIG. 4 and the plan view such as FIG. 2, the month indicator or month indication wheel 60 includes a month indication wheel guiding pipe 61 which is inserted into a cylindrical portion 16*a*1 of the hour wheel & pinion 16*a* with an allowance and is fixed to the date indicator maintaining plate 21, a month cam 64 which is rotatably fitted to the guiding pipe 61 at a hub portion 62 and has a cam face 63 formed at the outer circumference thereof, a month wheel 66 which is fitted to the month cam 64 and includes twenty-four tooth portions 65, and a month indication plate portion 67 which is fixed to the month wheel 66.

The cam face 63 of the month cam 64 has a small-diameter arc-shaped cam face 63*a* corresponding to a long month where one month has 31 days, and a large-diameter arc-shaped cam face 63*b* corresponding to a short month where one month has 30 days or less.

The month wheel 66, which meshes with the month transmission wheel 50, is rotated by two teeth each time month transmission wheel 50 is rotated by two teeth per month, and is rotated once a year in the C1 direction around the central axis line C.

On the surface 67*a* on the dial side of the month indication plate portion 67, the characters LM indicating months from January to December are displayed at the same interval two by two (24 in total as a whole). The month indication plate portion 67, as can be seen from FIG. 4 and the like, has an outer circumferential edge which is slightly smaller than the inner circumferential edge of the date indication wheel portion 41 of the date indicator 40. Therefore, the characters LM indicating months provided on the surface 67*a* on the dial side of the month indication plate portion 67 indicate months in the predetermined regions 13*a* and 13*b* inside the month and date indication window 13 of the dial 12 at a position which is slightly closer to the central axis line C than the characters LD indicating dates provided on the surface 41*a* on the dial side of the date indication wheel portion 41.

The C1 direction rotation of the month indicator 60 is set by a month jumper 24 including a month jumper finger portion 24*a* and a month jumper spring portion 24*b*. As can be seen from FIGS. 4 to 6, a position shift in the thickness direction of the month indicator 60 is set by a month indicator maintaining plate 23 attached to the month indication guiding pipe 61 so as to set displacement toward the dial side of the month cam 64.

The automatic calendar mechanism 1 includes an operation lever 70 and a driving lever structure 4 along with the month cam 64.

As shown in FIG. 2, the operation lever 70 has an arm portion 72 which is rotatable in the E1 and E2 directions around the central axis line E of the shaft 71, and a spring portion 74 which biases a tooth-shaped engaged portion 73 at the front end and the arm portion 72 in the E2 direction. The arm portion is formed from an arm portion main body 75 which is substantially straight, and a connection arm portion 76 which extends from the front end of the arm portion main body 75 to the base end of the tooth-shaped engaged portion 73 and has a C shape. The shaft 71, as shown in FIG. 4, is formed from a pin fitted to the date indication wheel portion 41, and the pin 71 is rotatably fitted to a hole 77 of the main body portion 75 of the arm portion 72 at a small-diameter portion 71*a*. The operation lever 70, as can be seen from the cross-sectional view of FIG. 4, is located substantially at the same position as the tooth portions 47 of the date wheel portion 45 of the date indicator 40 or the date finger 32 of the date indicator driving wheel 30 when seen from the thickness direction of the timepiece 2, and is located between the date indicator maintaining plate 21 and an arc-shaped arm portion 92 of a second driving lever 90, described later, of the driving lever structure 4.

The spring portion 74 comes into contact with the front end portion 74*a* and the outer circumferential portion of the small-diameter and thick cylindrical portion 42*c* of the date indicator 40, and is normally set to a non-engagement position or a a retreat position 21 (for example, FIG. 2) as a normal feed allowing position where the arm portion 72 and the tooth-shaped engaged portion 73 of the operation lever 70 is biased in the E2 direction. The tooth-shaped engaged portion 73 is located at a position which exactly faces the notched portion 48 of the date indicator 40, and the tooth-shaped engaged portion 73 is set to an engagement position or a projection position P2 as a pre-feed allowing position, for example, as shown in (a) of FIG. 8 or the like when the operation lever 70 is rotatably biased in the E1 direction.

The driving lever structure 4 is formed from a first driving lever 80 and the second driving lever 90.

Figure 5:
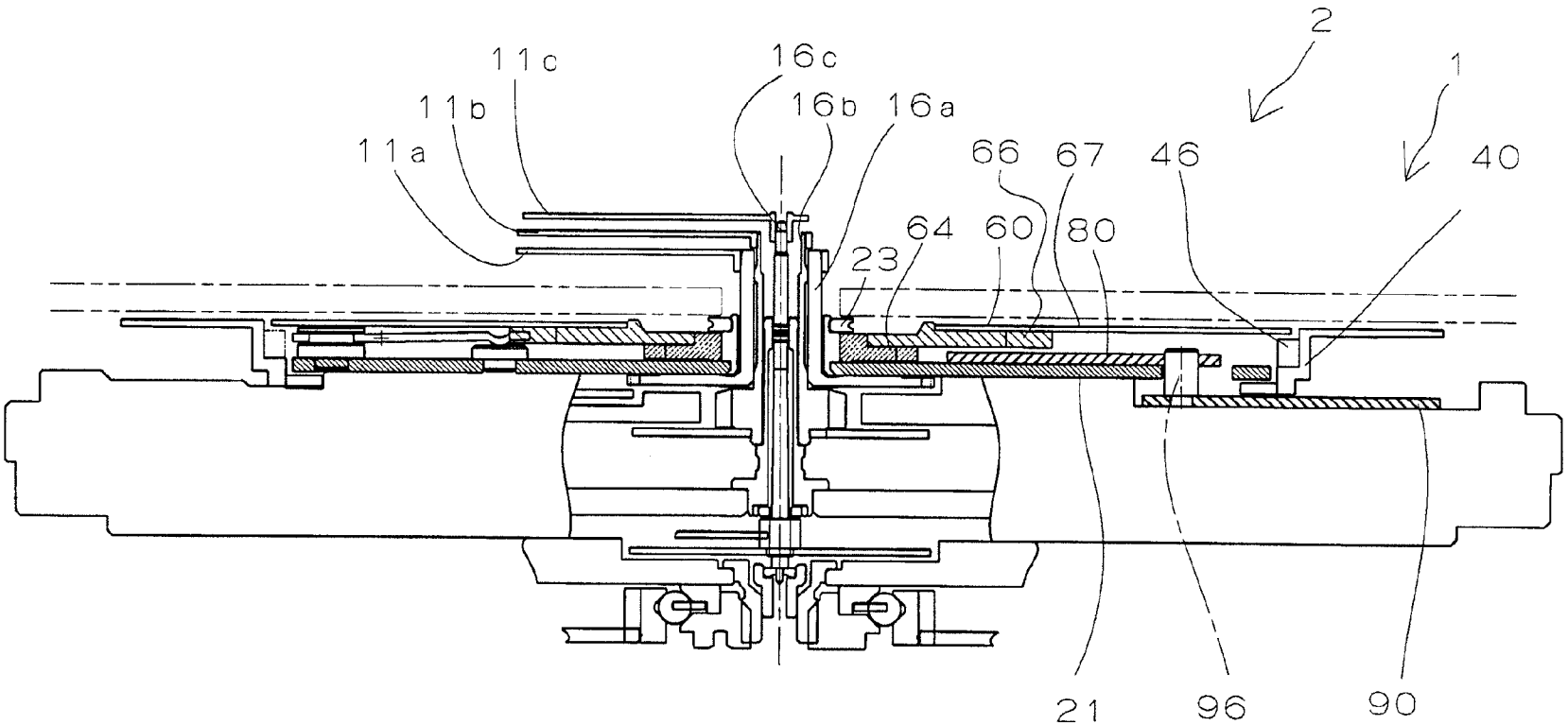
FIG. 5 is another cross-sectional view of the timepiece shown in FIG. 1.

The first driving lever 80 includes an arc-shaped arm portion 81, and a straight arm portion 82 which extends from an intermediate portion 81*a* of the arc-shaped arm portion 81 substantially outward in the diameter direction. The arc-shaped arm portion 81 is formed from a base end side arc-shaped arm portion 83 which is located further on the base end side than the intermediate portion 81*a*, and a front end side arc-shaped arm portion 84 which is located further on the front end side than the intermediate portion 81*a*. A cam follower portion 85 which extends substantially inward in the diameter direction is formed at the base end side arc-shaped arm portion 83. The straight arm portion 82 is rotatable in the A1 and A2 directions via a pin 86 when the central axis line A is rotated. The pin 86 is attached to the date indicator maintaining plate 21 at the large-diameter portion as shown in FIG. 4. The first driving lever 80 has an engagement recess portion 87 which is engaged with the base end side of the second driving lever 90 at the front end portion 84*a* of the front end side arc-shaped arm portion 84. The first driving lever 80, as can be seen from the cross-sectional views of FIGS. 4 and 5, is located between the date indicator maintaining plate 21 and the month wheel 66 of the month indicator 60 and substantially at the same position as the month cam 64 when seen from the thickness direction of the timepiece 2.

Figure 6:
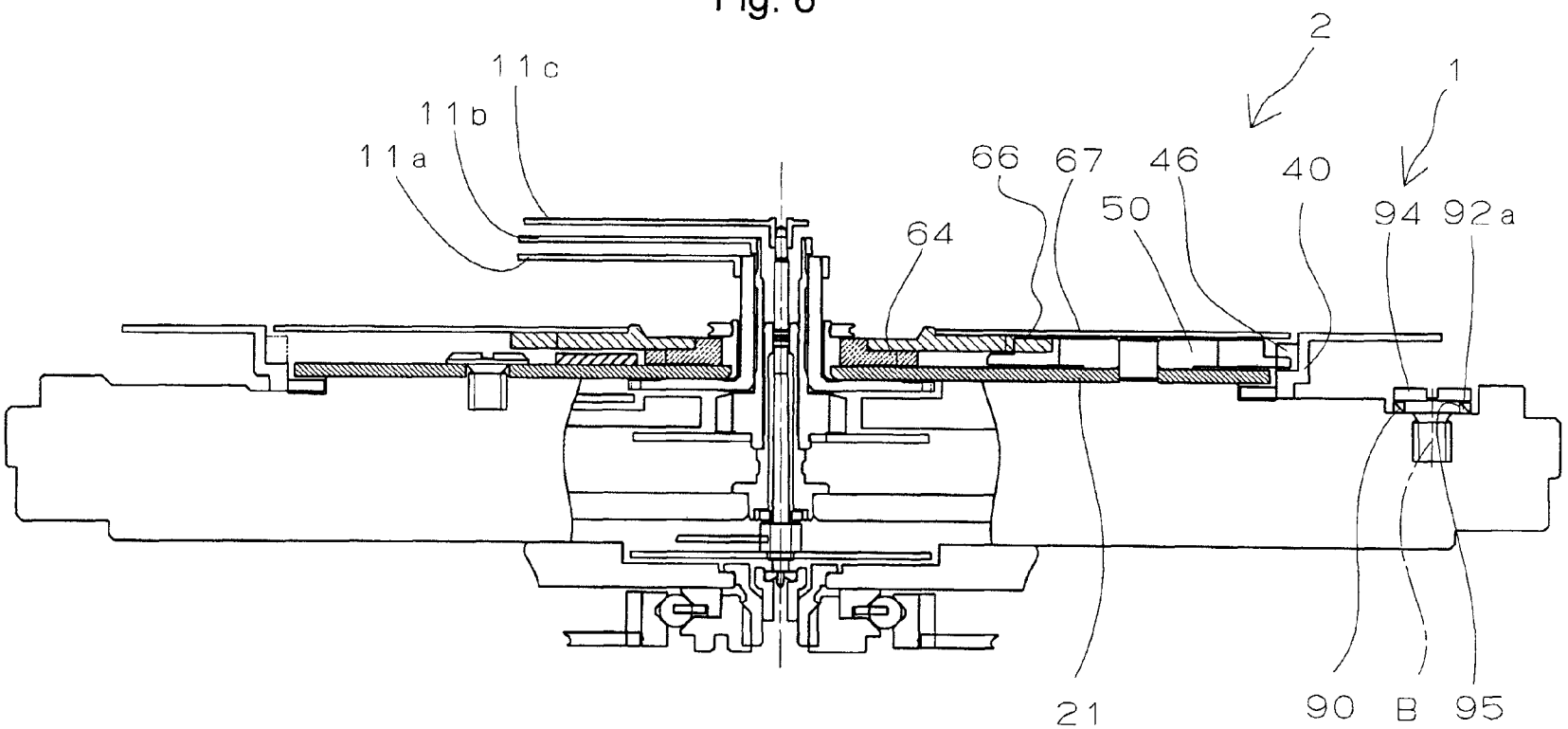
FIG. 6 is still another cross-sectional view of the timepiece shown in FIG. 1.

The second driving lever 90 has a straight arm portion 91, an arc-shaped arm portion 92, and a spring portion 93, and is rotatable in the B1 and B2 directions around the rotation central axis line B of one end portion 92*a* of the arc-shaped arm portion 92. More specifically, the second driving lever 90, as shown in FIG. 6, is rotatably fitted to a pin 94 fixed to the main plate 6 with screws, in a hole portion 95 located at an end portion 92*a*. The arc-shaped arm portion 92 of the second driving lever 90, as can be seen from the cross-sectional views of FIGS. 4 to 6, is located slightly further on the case backside (a distant side from the dial 12) than the arm portion 72 of the operation lever 70 in the recess portion for lever disposing operation of the main plate 6 in a view seen in the thickness direction of the timepiece 2.

The straight arm portion 91 is provided with a pin-shaped engagement portion 96 at one end 91*a*, and is engaged with the engagement recess portion 87 of the first driving lever 80 at the pin-shaped engagement portion 96. The straight arm portion 91 is connected to an intermediate portion 92*b* of the arc-shaped arm portion 92 at the other end portion 91*b*. The spring portion 93 is connected to a side edge 92*c* of the end portion 92*a* of the arc-shaped arm portion 92 at the base end portion 93*a*, and is locked to the wall portion 6*b* of the standstill member such as the main plate 6 at the front end portion 93*b*, thereby applying a bias force to the second driving lever 90 in the B2 direction. Therefore, the second spatial light modulation element 90 applies an A1 direction bias force to the first driving lever 80 through the engagement of the pin-shaped engagement portion 96 and the engagement recess portion 87 of the first driving lever 80, and thereby presses the cam follower portion 85 of the first driving lever 80 toward the cam face 63 of the month cam 64.

The arc-shaped arm portion 92 of the second driving lever 90 is further provided with a pin-shaped pressing portion 97 at one end portion (front end portion) 92*d*. When the cam follower portion 85 of the first driving lever 80 is pushed by the short month cam face 63*b* of the cam face 63 of the month cam 64, and the first spatial light modulation element 80 is rotated in the A2 direction, the second driving lever 90 is rotated in the B1 direction through the engagement of the engagement portions 87 and 96, thus the pin-shaped pressing portion 97 of the second driving lever 90 presses the outer surface 78 of the arm portion main body 75 of the operation lever 70, and thereby the tooth-shaped engaged portion 73 at the front end is rotatably displaced from the retreat position P1 as a normal feed allowing position to the projection position P2 as a pre-feed allowing position in the E1 direction.

Figure 3:
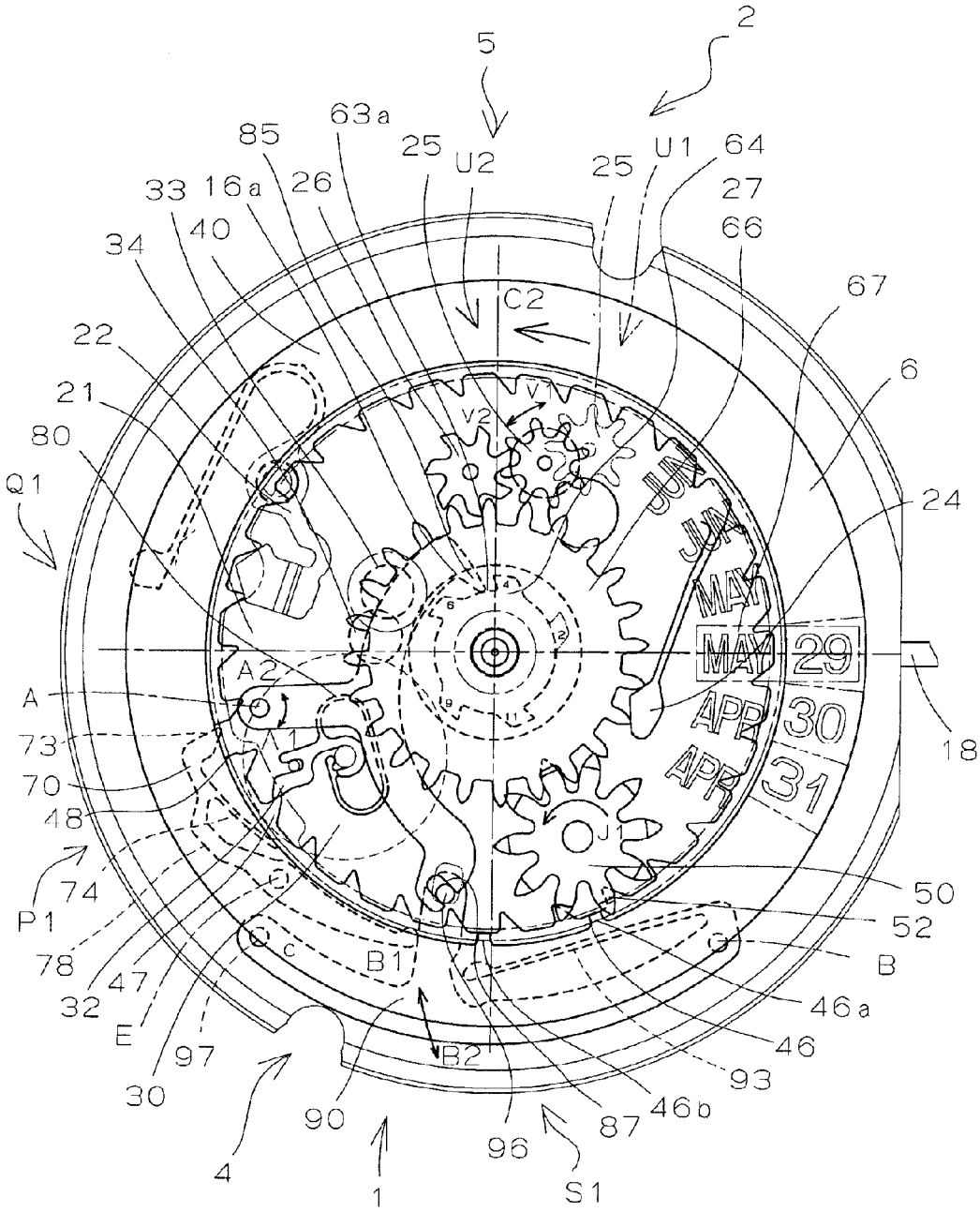
FIG. 3 is a plan view illustrating the same state as in FIG. 2 and shows the timepiece indicating May, 29.

Therefore, in a long month, since the cam follower portion 85 of the first driving lever 80 of the driving lever structure 4 comes into contact with the small-diameter arc-shaped cam face 63*a* of the month cam 64 according to the rotation of the month indicator 60, a long month position Q1 is selected at which the first driving lever 80 of the driving lever structure 4 is rotated in the A1 direction. At this time, since the engagement recess portion 87 of the first driving lever 80 retreats, the straight arm portion 91 at which the pin-shaped engagement portion 96 of the second driving lever 90 is located and the arc-shaped arm portion 92 which is integral therewith are rotatably displaced in the B2 direction under the application of the spring force of the spring portion 93. As a result, as shown in FIG. 3, the pin-shaped pressing portion 97 located at the front end portion of the arc-shaped arm portion 92 of the second driving lever 90 of the driving lever structure 4 is located outside the trajectory of the operation lever 70 (the trajectory through which the outer surface portion 78 of the operation lever 70 attached to the date indicator 40 and located at the retreat position P1 as a normal feed allowing position passes when the date indicator 40 is rotated in the C2 direction). More specifically, in the second driving lever 90, the pin-shaped pressing portion 97 takes a long month position S1 which is located outside the trajectory of the operation lever 70 (the trajectory through which the outer surface portion 78 of the operation lever 70 attached to the date indicator 40 and located at the retreat position P1 passes when the date indicator 40 is rotated in the C2 direction), at least in an angle region where the date finger 32 is scanned. Therefore, in a long month, the driving lever structure 4 does not operate or displace the operation lever 70 in practice.

On the other hand, since the cam follower portion 85 of the first driving lever 80 of the driving lever structure 4 comes into contact with the large-diameter arc-shaped cam face 63*b* of the month cam 64 in a short month, a short month position Q2 is selected at which the first driving lever 80 of the driving lever structure 4 is rotated in the A2 direction. At this time, the engagement recess portion 87 of the first driving lever 80 presses the pin-shaped engagement portion 96 of the second driving lever 90 against a spring force of the spring portion 93, and thereby the straight arm portion 91 at which the pin-shaped engagement portion 96 of the second driving lever 90 is located and the arc-shaped arm portion 92 which is integral therewith are rotatably displaced in the B1 direction. As a result, the pin-shaped pressing portion 97 located at the front end portion of the arc-shaped arm portion 92 of the second driving lever 90 of the driving lever structure 4 is located inside the trajectory of the operation lever 70 (the trajectory through which the outer surface portion 78 of the operation lever 70 attached to the date indicator 40 and located at the retreat position P1 as a normal feed allowing position passes when the date indicator 40 is rotated in the C2 direction) as shown in FIG. 2 or the like. More specifically, in the second driving lever 90, the pin-shaped pressing portion 97 takes a short month position S2 which is located inside the trajectory of the operation lever 70 (the trajectory through which the outer surface portion 78 of the operation lever 70 attached to the date indicator 40 and located at the retreat position P1 passes when the date indicator 40 is rotated in the C2 direction), in an angle region where the date finger 32 is scanned. Therefore, in a short month, when the operation lever 70 enters the scanning region of the date finger 32, the driving lever structure 4 operates and displaces the operation lever 70.

Next, an operation of the calendar mechanism 1 of the timepiece 2 with the automatic calendar mechanism 1 having the above-described configuration will be described.

For example, in a long month where one month has thirty-one days such as May, as shown in FIG. 3, the first driving lever 80 of the driving lever structure 4 is rotated in the A1 direction under the application of the spring force of the spring portion 93 of the second driving lever 90, and thus the long month position Q1 is selected at which the cam follower portion 85 comes into contact with the small-diameter cam face 63*a* of the month cam 64 of the month indicator 60. Thereby, the long month position S1 is selected at which the second driving lever 90 is rotated in the B2 direction through the engagement of the engagement portions 87 and 96, and the pin-shaped pressing portion 97 of the second driving lever 90 is located outside the rotation trajectory of the operation lever 70 in practice. Therefore, regardless of the rotation of the date indicator 40, the operation lever 70 takes the retreat position P1 as a normal feed allowing position which is biased in the E2 direction under the application of the spring force of the spring portion 74 as shown in FIG. 3, and the tooth-shaped engaged portion 73 of the operation lever 70 is not projected inward in the diameter direction from the notched portion 48 of the date indicator 40.

As a result, regardless of the rotation position of the date indicator 40, when the date finger 32 is rotated once a day, more specifically, a date is changed, the date wheel portion 45 is intermittently rotated by one tooth in the counterclockwise rotation C2 through engagement with the tooth portions 47 closest to the date wheel portion 45. This operation is practically the same for thirty-one days (every day during May).

In addition, if an end of the month comes, the month feed tooth portion 46 of the date indicator 40 is engaged with the teeth 52 of the month transmission wheel 50 so as to rotate the month transmission wheel 50 in the J1 direction, in turn the month transmission wheel 50 rotates the month wheel 66, and thereby a month indication of the month indication plate portion 67 proceeds. In this example, at a portion where a date is changed from 29-th date to 30-th date, the month feed tooth 46*a* on the front side rotates the month indicator 60 by one tooth via the month transmission wheel 50, and at a portion where a month is changed (a portion where a month is changed from 31-st date to 1-st date), the month feed tooth 46*b* on the rear side rotates the month indicator 60 by one tooth via the month transmission wheel 50, thereby changing the month indication by the month indication plate portion 67 of the month indicator 60, for example, from May (MAY) to June (JUN).

Figure 7:
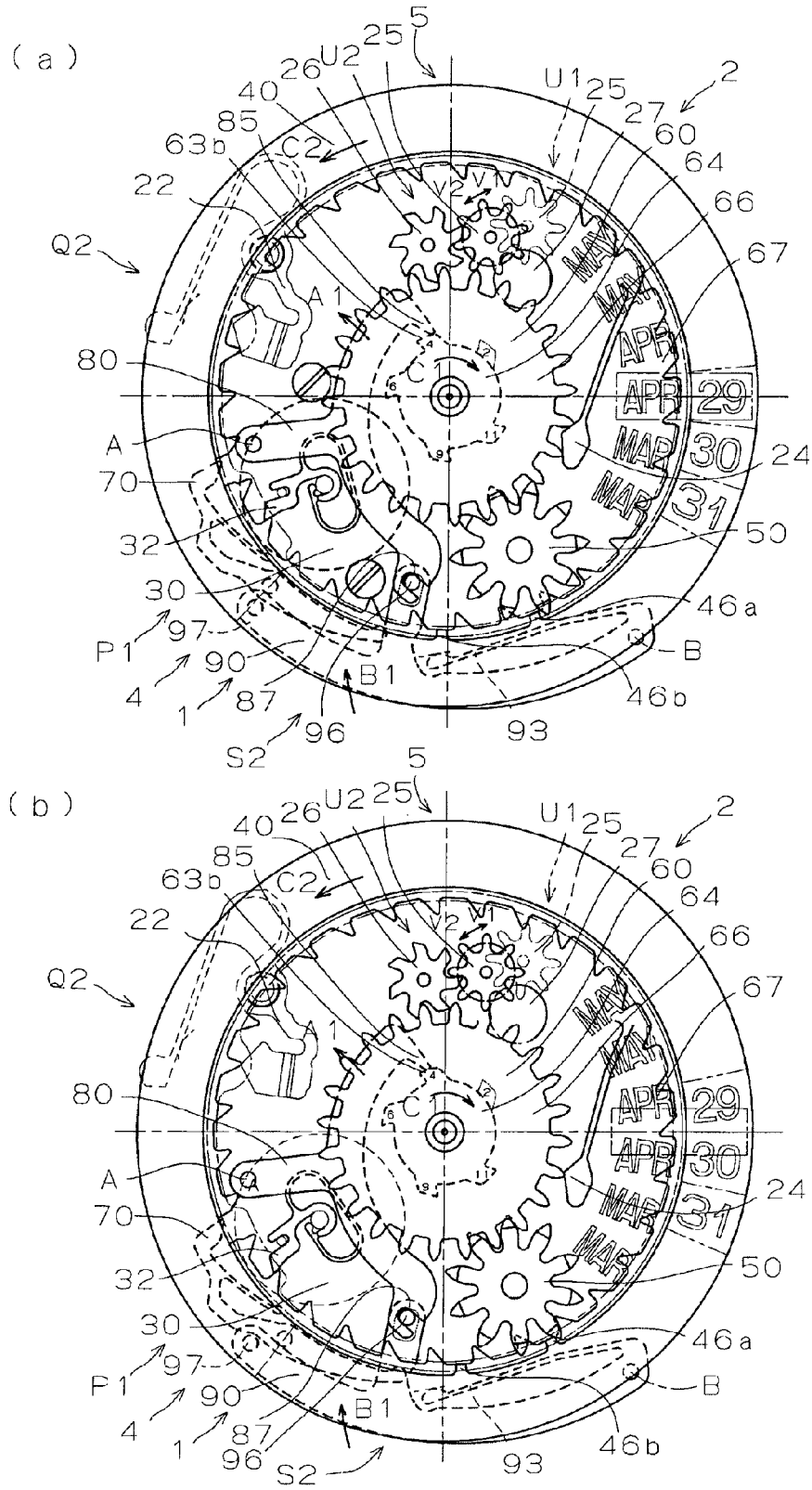
FIG. 7 shows a state where the timepiece shown in FIG. 2 indicates April 29, wherein (a) is a plan view which is the same as FIG. 2 before a date change (changing in date indication) from April 29 to the next day is started, and (b) is a plan view which is the same as FIG. 2 immediately before a date change from April 29 to the next day is started.

On the other hand, for example, in a short month where one month has thirty days such as April, as described above, for example, as shown in FIG. 2 or (a) of FIG. 7, the first driving lever 80 of the driving lever structure 4 is rotated in the A2 direction against the spring force of the spring portion 93 of the second driving lever 90, and the short month position Q2 is selected at which the cam follower portion 85 comes into contact with the large-diameter cam face 63*b* of the month cam 64 of the month indicator 60. Thereby, the short month position S2 is selected at which the second driving lever 90 is rotated in the B1 direction through the engagement of the engagement portions 87 and 96, and the pin-shaped pressing portion 97 of the second driving lever 90 enters a range of the rotation trajectory of the operation lever 70.

In a state where the first and second driving levers 80 and 90 constituting the driving lever structure 4 are located at the short month positions Q2 and S2, with the passage of days, the date finger 32 feeds the tooth portions 47 of the date wheel portion 45 of the date indicator 40 by one tooth a day in the counterclockwise rotation C2 each time when the date indicator driving wheel 30 is rotated once, and a date displayed in the date indication region 13*b* of the month and date indication window 13 of the dial 12 is increased one by one from "1".

As shown in (a) of FIG. 7, around an end of the 29-th date (in this example, for example, around 22:(10 o'clock p.m.) 44), the date finger 32 is engaged with the closest tooth portion 47 of the date wheel portion 45.

Thereafter, with the passage of time, by the rotation of the date indicator driving wheel 30 according to the rotation of the hour wheel & pinion 16*a*, the date finger 32 rotates the date indicator 40 in the C2 direction as shown in (b) of FIG. 7. Thereby, the tooth portion 46*a* on the front side of the month feed tooth portion 46 of the date indicator 40 reaches a state immediately before starting to be engaged with the tooth portion 52 of the month transmission wheel 50, and the month indicator 60 also reaches a state immediately before being rotated in the C1 direction. By the C2 direction rotation of the date indicator 40, the front end of the finger portion 22*a* of the date jumper 22 reaches a top of the tooth portion 47, which leads to a state immediately before a date is changed in (b) of FIG. 7. In addition, in (b) of FIG. 7, the outer surface 78 of the operation lever 70 which is rotated in the C2 direction along with the date indicator 40 reaches a state immediately before coming into contact with the pin-shaped pressing portion 97 of the second driving lever 90 which is located at the short month position S2 interfering with the operation lever 70.

Figure 8:
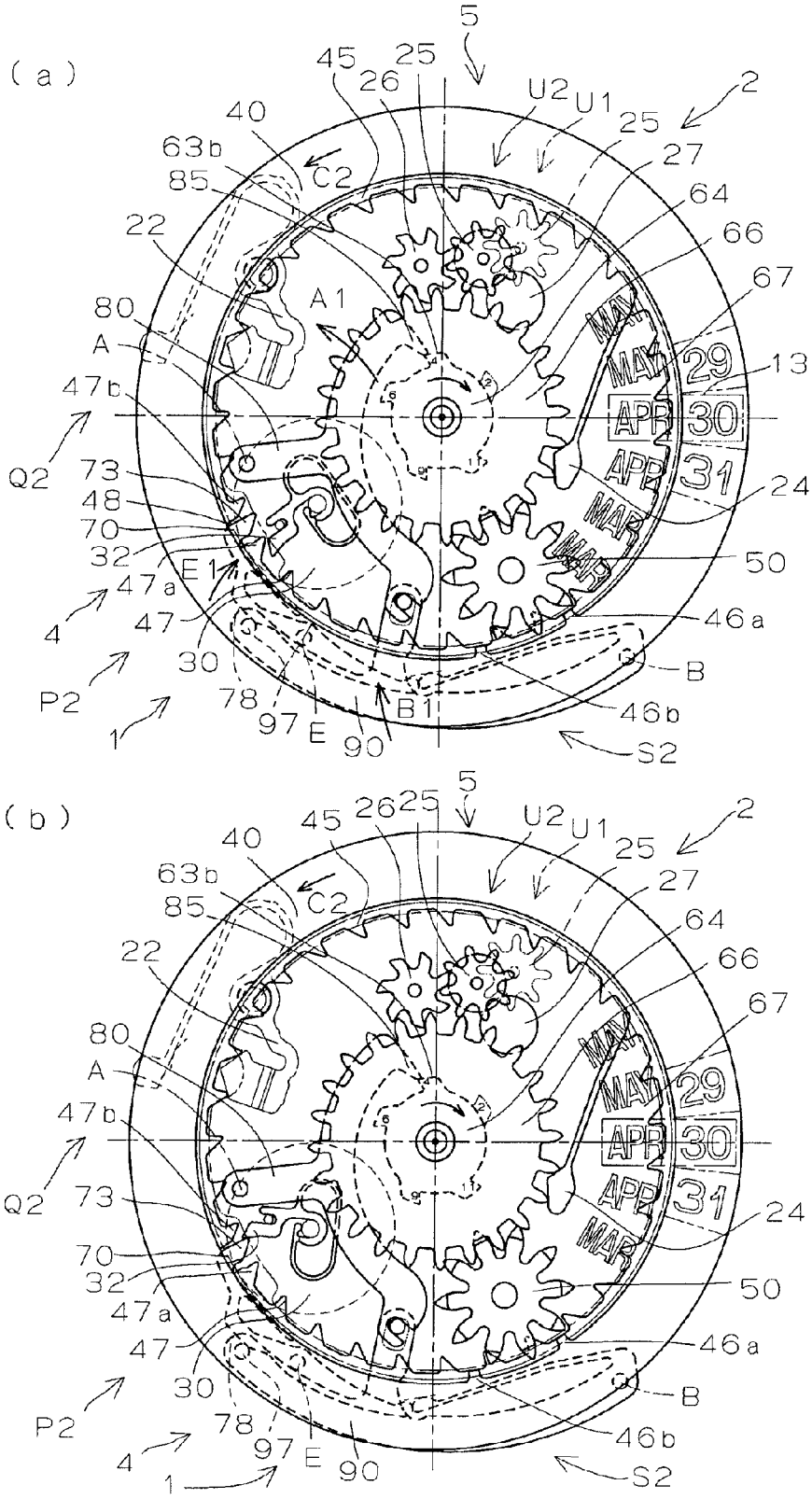
FIG. 8 shows a state where the timepiece shown in FIG. 2 indicates April 30, wherein (a) is a plan view which is the same as FIG. 2 before a date change (changing in date indication) from April 30 to the next day is started, and (b) is a plan view which is the same as FIG. 2 immediately before two changes in the date indication from April 30 corresponding to the end of the month of the short month to the next day are started.

If the date jumper 22 jumps, the state shown in (b) of FIG. 7 is moved to a state immediately after the indication is changed to April 30 as shown in (a) of FIG. 8. At this time, since the month feed tooth 46*a* on the front side rotates the month indicator 60 by one tooth in the C1 direction via the month transmission wheel 50, the cam follower portion 85 is displaced in the circumferential direction along the large-diameter cam face 63*b* of the month cam 64, but the diameter direction position of the cam follower portion 85 is not changed, and thus the first and second driving levers 80 and 90 stay at the positions Q2 and S2 which are practically the same as in the case of (b) of FIG. 7.

On the other hand, since the jumper 22 rotates the date wheel portion 45 by half tooth in the C2 direction the tooth 47 of the date wheel portion 45 becomes distant from the date finger 32, and the next tooth 47 reaches a predetermined position close to the rear side of the date finger 32. This tooth 47 is a tooth 47*a* on the front side with the interposed notched portion 48.

In addition, in a state of April (short month) 30, since the outer surface 78 located at the outermost part in the operation lever 70 is pressed by the pin-shaped pressing portion 97 of the second driving lever 90 which has entered the C2 direction rotation trajectory of the outer surface 78 according to the intermittent rotation in the counterclockwise rotation C2 of the date indicator 40, the operation lever 70 is rotated in the E1 direction against the spring force of the spring portion 74, and the tooth-shaped engaged portion 73 at the front end of the operation lever 70 is fitted to the notched portion 48 between the tooth portions 47*a* and 47*b* of the date wheel portion 45 of the date indicator 40. At this time, the tooth-shaped engaged portion 73 at the front end of the operation lever 70 takes the projection position P2 as a pre-feed allowing position which is located inside the trajectory of the date finger 32 which is larger than the typical tooth portions 47 constituting the date wheel portion 45 of the date indicator 40 and is projected inward in the radius direction as shown in (a) and (b) of FIG. 8. In addition, as long as the projection position P2 of the tooth-shaped engaged portion 73 at the front end of the operation lever 70 is located in the trajectory of the date finger 32, and the tooth-shaped engaged portion 73 at the front end of the operation lever 70 can be engaged with the date finger 32, a projection amount of the tooth-shaped engaged portion 73 at the front end of the operation lever 70 may be somewhat smaller than a projection amount of the tooth portions 47 in an extent of being equal to a projection amount of the tooth portion 47 instead of being larger than the projection amount of the tooth portions 47 of the date wheel portion 45.

Thereafter, with the passage of time, the hour wheel & pinion 16*a* is rotated, the date indicator driving wheel 30 is rotated according thereto, and, as shown in (b) of FIG. 8, the date finger 32 is substantially rotated once and starts to mesh with the tooth-shaped engaged portion 73 of the operation lever 70 which is projected in the notched portion 48. In this example, this operation is performed around 21:19. That is to say, if the time reaches around 9:20 p.m. on April 30, a date feed operation starts at a time zone which is earlier than the normal date starting time (for example, as described above, around 10:45 p.m.) but is substantially the same extent. In other words, in this example, the date finger 32 is engaged with the tooth-shaped engaged portion 73 of the operation lever 70 attached to the date indicator 40 and feeds it, thereby rotating the date indicator 40 in the C2 direction.

Figure 9:
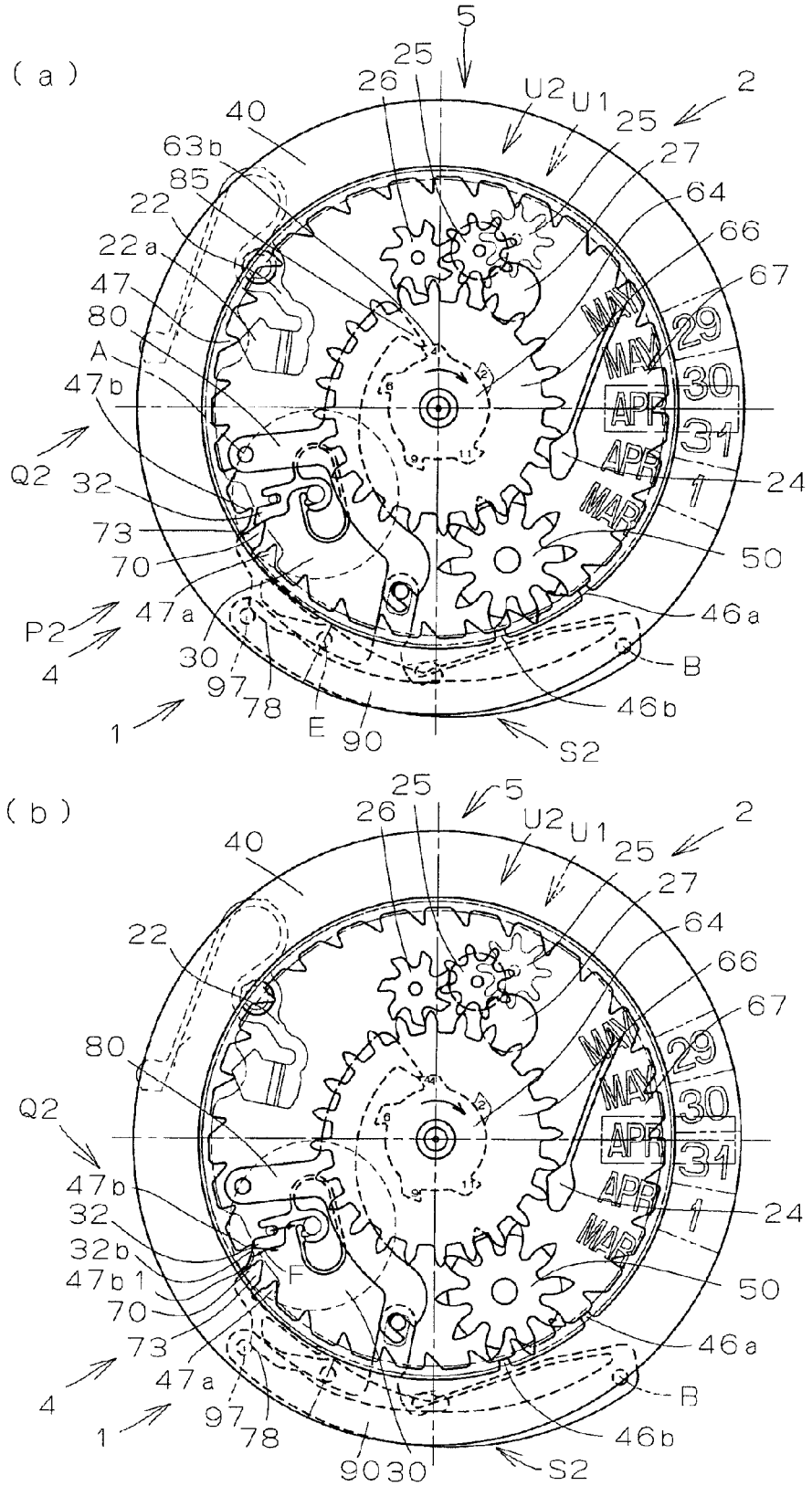
FIG. 9 shows an intermediate state where the timepiece shown in FIG. 2 is being changed from April 30 to May 1, wherein (a) is a plan view which is the same as FIG. 2 in the first change of the two changes in the date indication from April 30 corresponding to the end of the month of the short month to the next day, and (b) is a plan view which is the same as FIG. 2 immediately before the first change of the two changes in the date indication from April 30 corresponding to the end of the month of the short month to the next day is completed.

(a) of FIG. 9 shows a state immediately before the C2 direction rotation of the date indicator 40 progresses in a state where the date finger 32 is engaged with the tooth-shaped engaged portion 73 of the operation lever 70 inserted into the notched portion 48 between the tooth portions 47*a* and 47*b* of the date wheel portion 45 and thereby the date jumper 22 jumps. Here, since the tooth-shaped engaged portion 73 of the operation lever 70 is engaged with the date finger 32 further on the upstream side than the tooth portion 47*a* which is fed by the date finger 32 in a normal case, feeding of the date indicator 40 starts earlier than in a normal case to some extent (in this example, about one and a half hours), and the date jumper finger portion 22*a* of the date jumper 22 jumps with respect to the tooth portion 47 located at the engagement position earlier than in the normal case. In addition, in this state, the month feed tooth 46*b* on the rear side does not reach the tooth 52 part of the month transmission wheel 50, and thus month feeding is not performed.

If the date jumper 22 jumps, a state immediately after that is a state as shown in (b) of FIG. 9. That is to say, the first and second driving levers 80 and 90 constituting the driving lever structure 4 stay at the practically same positions Q2 and S2, but the front edge 47*b*1 of the tooth portion 47*b* immediately following (on the stream side) the tooth-shaped engaged portion 73 of the operation lever 70 in the date wheel portion 45 hits the rear edge 32*b* at the front end portion of the date finger 32 according to the C2 direction rotation of the date indicator 40, thereby applying a force to the date finger 32 in the F direction. Further, the tooth portion 47*b* of the date wheel portion 45 starts an overtaking operation of overtaking the date finger 32 in the C2 direction while retracting the date finger 32 in the F direction.

Figure 10:
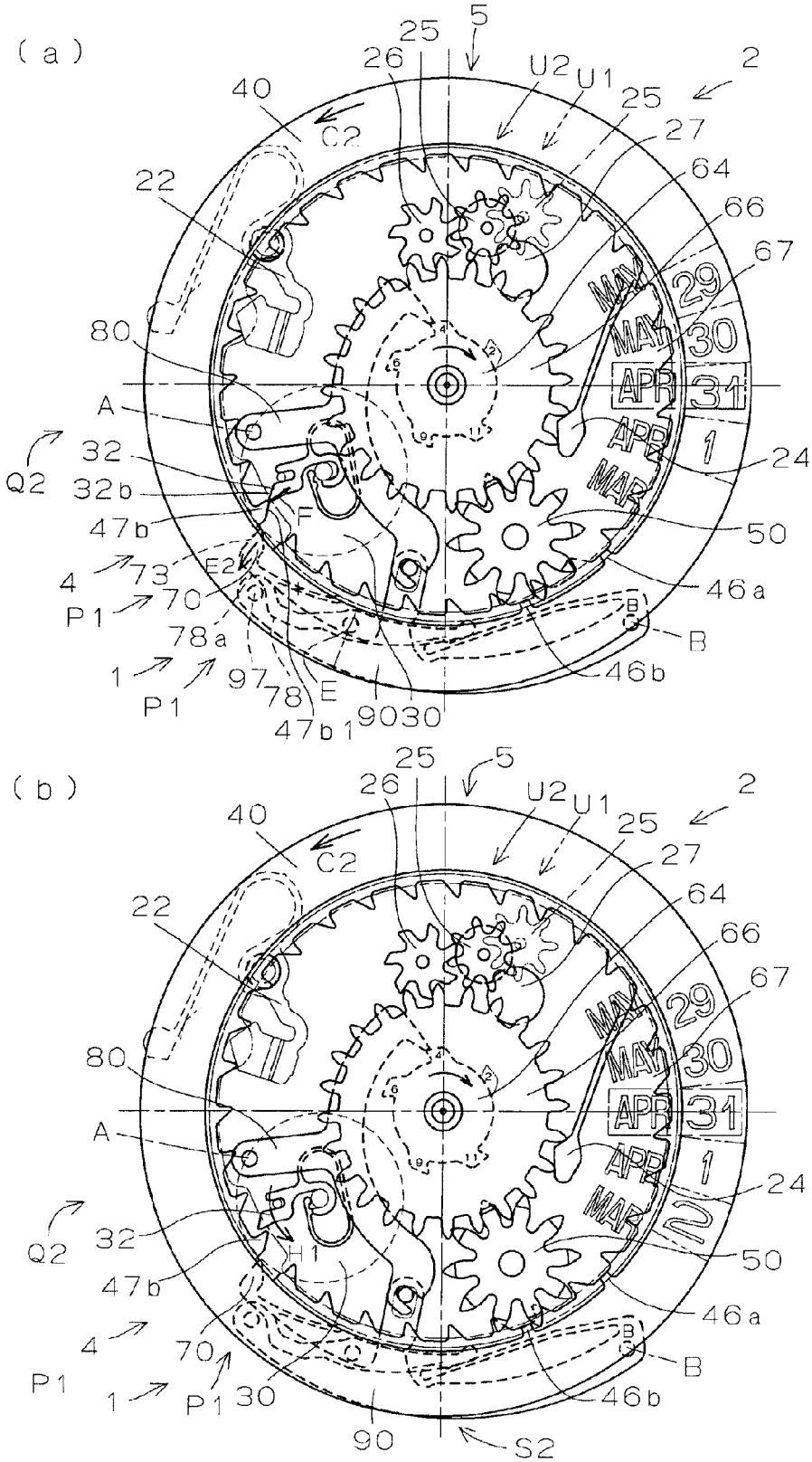
FIG. 10 shows an intermediate state where the timepiece shown in FIG. 2 is being changed from April 30 to May 1, wherein (a) is a plan view which is the same as FIG. 2 and shows a state immediately after the first change of the two changes in the date indication from April 30 corresponding to the end of the month of the short month to the next day is completed, and (b) is a plan view which is the same as FIG. 2 and shows a state where the timepiece enters a process for a second change after the first change of the two changes in the date indication from April 30 corresponding to the end of the month of the short month to the next day is completed.

At the time immediately before the jumping operation of the date jumper 22 is completed, as shown in (a) of FIG. 10, the front end of the front edge 47*b*1 of the tooth portion 47*b* on the rear side of the notched portion 48 of the date wheel portion 45 corresponds to the front end of the rear edge 32*b* of the date finger 32. During this time, the first and second driving levers 80 and 90 constituting the driving lever structure 4 are practically maintained at the same positions Q2 and S2. On the other hand, since the pin-shaped pressing portion 97 of the second driving lever 90 is engaged with the outer surface 78*a* which retreats inward in the diameter direction in the outer surface 78 of the operation lever 70 according to the C2 direction rotation of the date indicator 40, the operation lever 70 is rotated in the E2 direction, the tooth-shaped engaged portion 73 thereof escapes from the notched portion 48 and returns to the retreat position P1 as a normal feed allowing position.

At the time when the jumping operation of the date jumper 22 is completed, as shown in (b) of FIG. 10, the tooth portion 47*b* on the rear side of the notched portion 48 is set by the date jumper 22 at a position (date feed position) where it completely overtakes the date finger 32. At this time, the date finger 32 is located on the rear side of the tooth portion 47*b* of the date wheel portion 45 reaching the date feed position, and thus the tooth portion 47*b* can be made to feed a date through the H1 direction rotation of the date indicator driving wheel 30. In addition, the first and second driving levers 80 and 90 constituting the driving lever structure 4 are practically maintained at the same positions Q2 and S2, and the operation lever 70 is also maintained at the retreat position P1 as a normal feed allowing position at which the tooth-shaped engaged portion 73 escapes from the notched portion 48.

Figure 11:
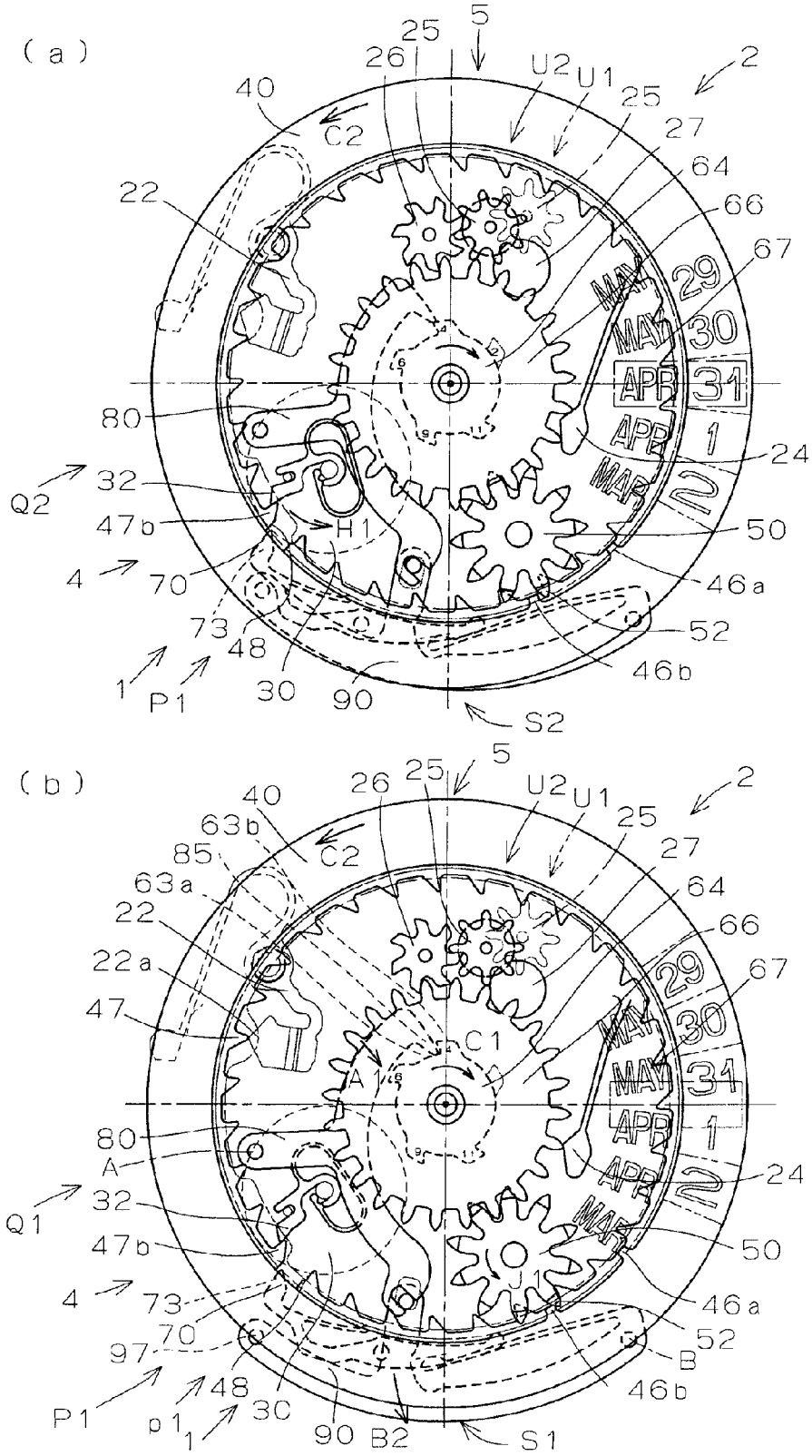
FIG. 11 shows an intermediate state where the timepiece shown in FIG. 2 is being changed from April 30 to May 1, wherein (a) is a plan view which is the same as FIG. 2 and shows a state where the second change of the two changes in the date indication from April 30 corresponding to the end of the month of the short month to the next day is started, and (b) is a plan view which is the same as FIG. 2 and shows an intermediate state where the second change of the two changes in the date indication from April 30 corresponding to the end of the month of the short month to the next day is in progress.

According to the rotation of the hour wheel & pinion 16*a* with the passage of time, the date indicator driving wheel 30 is rotated in the H1 direction, and, as shown in (a) of FIG. 11, the date finger 32 starts to feed the tooth 47*b* of the date wheel portion 45 located at the date feed position. This time point is 22 (10 o' clock p.m.):44 in this example. At this time, the month feed tooth 46*b* is in a state immediately before coming into mesh with the tooth portion 52 of the month transmission wheel 50 according to the C2 direction rotation of the date indicator 40, and, thereafter, month feeding progresses in the progress of the date feeding. On the other hand, during this time, the first and second driving levers 80 and 90 constituting the driving lever structure 4 are practically maintained at the same positions Q2 and S2, and the operation lever 70 is also maintained at the retreat position P1 as a normal feed allowing position at which the tooth-shaped engaged portion 73 escapes from the notched portion 48.

If the date feeding by the date finger 32 of the date indicator driving wheel 30, that is, feeding of the tooth 47*b* of the date wheel portion 45 of the date indicator 40 progresses, and the date indicator 40 is rotated by a half pitch of the date wheel portion 45, it leads to a state shown in (a) of FIG. 11. At this time, the front end of the date jumper finger portion 22*a* of the date jumper 22 is in a state of practically coming into contact with the front end or the top point of the closest tooth portion 47 of the date wheel portion 45.

In this state, the month feed tooth 46*b* on the rear side of the date indicator 40 is engaged with the tooth 52 according to the C2 direction rotation of the date indicator 40, so as to rotate the month transmission wheel 50 in the J1 direction, thereby rotating the month indicator 60 in the C1 direction. Thereby, when the cam follower portion 85 of the first driving lever 80 is shifted from the corner of the large-diameter arc-shaped cam face 63*b* of the month cam 64, is thus rotated in the A1 rotation under the operation of the spring portion 93, and reaches the long month state or the position Q1 of coming into contact with the small-diameter arc-shaped cam face 63*a* of the month cam 64, the second driving lever 90 is also rotated in the B2 direction accordingly and returns to the long month position S1, and thus the pin-shaped pressing portion 97 is completely deviated from the trajectory of the operation lever 70. Therefore, in the state shown in (b) of FIG. 11, the date indication by the date indicator 40 reaches an intermediate state between "31" and "1", and the month indication by the month indicator 60 also reaches the middle between "April (APR)" and "May (MAY)". In addition, the operation lever 70 is maintained at the retreat position P1 as a normal feed allowing position where the tooth-shaped engaged portion 73 escapes from the notched portion 48.

Figure 12:
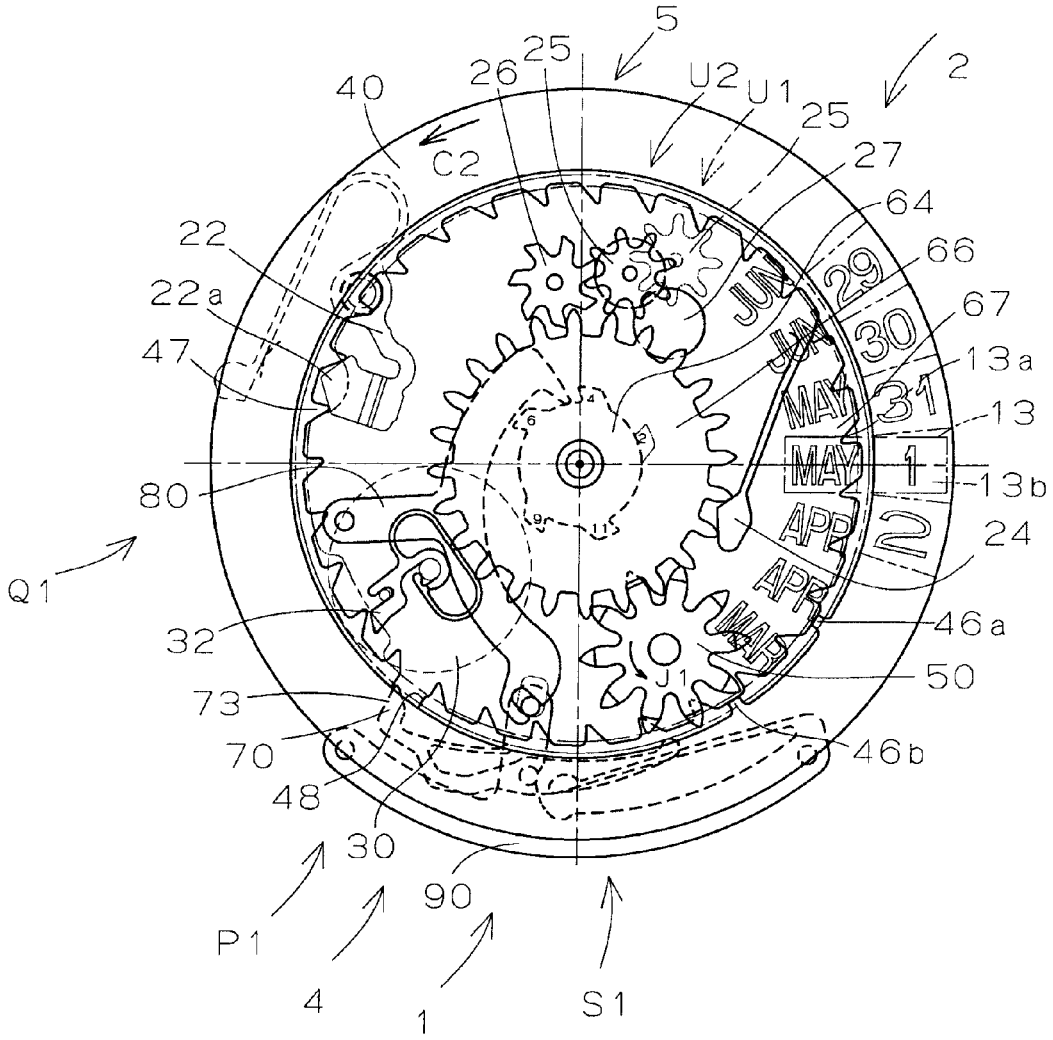
FIG. 12 is a plan view which is the same as FIG. 2 and shows a state immediately after the changes from April 30 to the next day are completed.

If the date jumper finger portion 22*a* of the date jumper 22 completes the jumping (leaping) operation, falls between the next teeth 47 and 47, and sets the date wheel portion 45, it leads to a state shown in FIG. 12. In this state, according to the C2 direction rotation of the date indicator 40, the date indication is changed from the state indicating the middle between "31" and "1" to a state completely indicating "1" in the date indication region 13*b* of the month and date indication window 13 of the dial 12. On the other hand, by the C2 direction rotation of the month feed tooth 46*b* according to the C2 direction rotation of the date indicator 40, the month transmission wheel 50 is also rotated in the J1 direction so as to rotate the month indicator 60 in the C1 direction, in turn, the month indication plate portion 67 of the month indicator 60 is also rotated in the C1 direction, and the month indication is changed from the state indicating the middle between "April (APR)" and "May (MAY)" to a state completely indicating "May (MAY)" in the month indication region 13*a* of the month and date indication window 13 of the dial 12. During this time, the first and second driving levers 80 and 90 constituting the driving lever structure 4 are practically maintained at the same long month positions Q1 and S1, and the operation lever 70 is also maintained at the retreat position P1 as a normal feed allowing position at which the tooth-shaped engaged portion 73 escapes from the notched portion 48. This leads to a state completely indicating the long month (in this example, a state indicating May 1). Thereafter, as described with reference to FIG. 3, date feeding in a long month is repeatedly performed.

Figure 13:
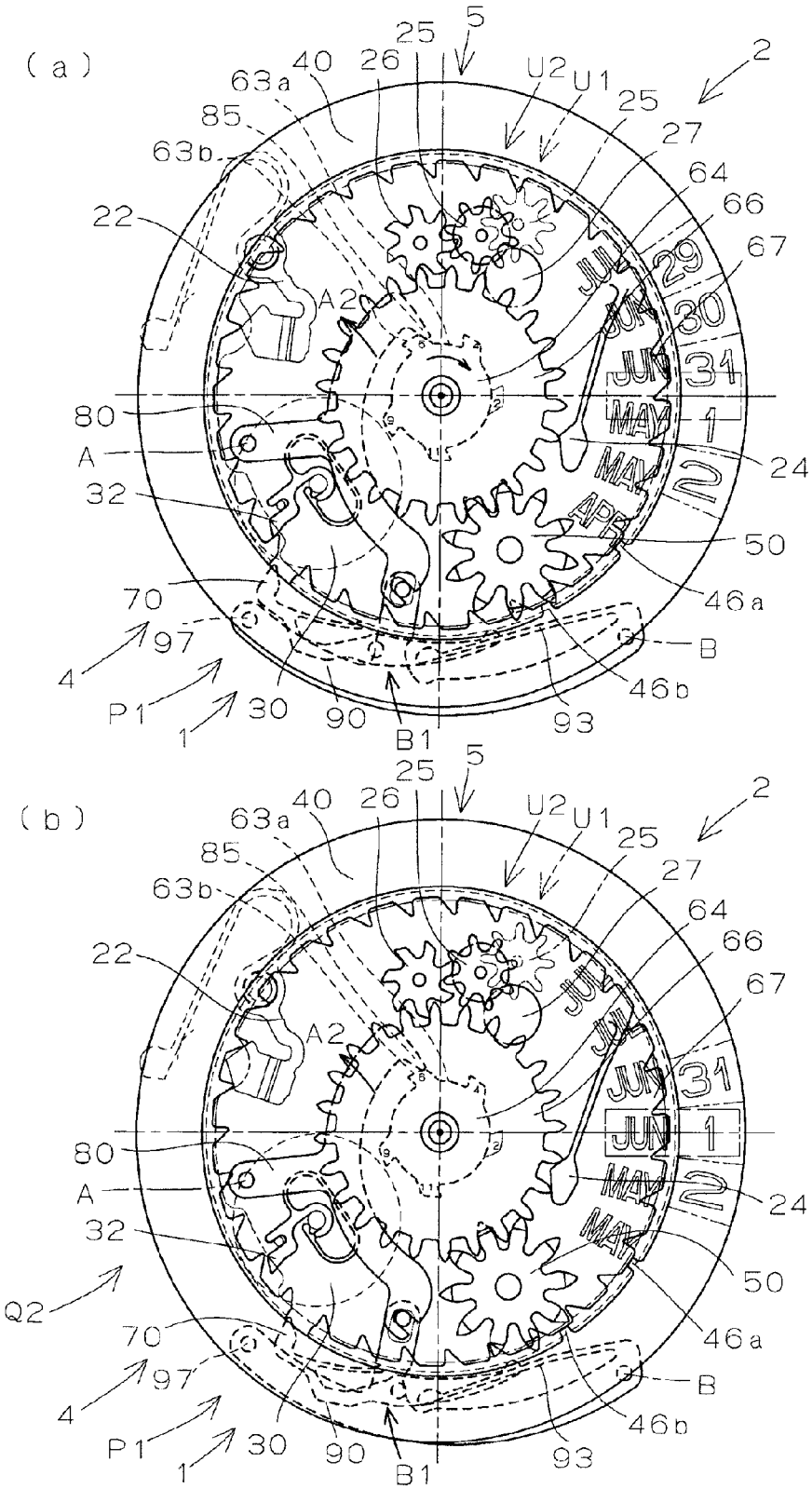
FIG. 13 shows the timepiece shown in FIG. 2 which performs a change in non-indication from May 31 to the next day, wherein (a) is a plan view which is the same as FIG. 2 and shows a state immediately before a date change from May 31 to the next day is made, and (b) is a plan view which is the same as FIG. 2 and shows a state immediately after a date change from May 31 to the next day (June 1) is made.

In addition, in a case where a long month transitions to a short month, as exemplified in (a) and (b) of FIG. 13, the cam follower portion 85 of the first driving lever 80 of the driving lever structure 4 is moved from the small-diameter arc-shaped cam face 63*a* corresponding to a long month of the month cam 64 to the large-diameter arc-shaped cam face 63*b* corresponding to a short month according to the C1 direction rotation of the month indicator 60 at the time of month changing, thereby the first driving lever 80 is rotated in the A2 direction against the spring force of the spring portion 93 so as to take the short month position Q2, and, further, the second driving lever 90 is rotated in the B1 direction against the spring force of the spring portion 93 so as to take the short month position S2. Therefore, the pin-shaped pressing portion of the second driving lever 90 enters the C2 direction rotation trajectory of the operation lever 70, thereby making a preparation for the end of the month process in a short month. Other configurations are the same as described with reference to FIG. 3.

In addition, the timepiece with calendar mechanism 2 includes a pivot wheel 25 which can be pivoted between a date corrector position U1 and a month corrector position U2 in the V1 and V2 directions, a month corrector setting wheel 26, and a corrector transmission wheel 27, as a manual calendar corrector mechanism 5. At a first hand setting stem stage where the crown 15 is pulled to draw out the hand setting stem 18, when the hand setting stem 18 is rotated in one direction, the pivot wheel 25 is moved to the date corrector position U1 in the V1 direction via the corrector transmission wheel 27 so as to mesh with the date wheel portion 45, and the date indicator 40 is rotated in the C2 direction according to the rotation in one direction of the hand setting stem 18, thereby correcting a date. On the other hand, at a secondhand setting stem stage, when the hand setting stem 18 is rotated in the reverse direction, the pivot wheel 25 is moved to the month corrector position U2 in the V2 direction so as to mesh with the month wheel 66, and the month indicator 60 is rotated in the C1 direction according to the reverse rotation of the hand setting stem 18, thereby correcting a month.

FIGS. 14 to 18 show a timepiece having an automatic calendar mechanism 1A as a calendar mechanism according to another preferred embodiment of the present invention, that is, a timepiece with calendar mechanism 2A. In the timepiece 2A with the calendar mechanism 1A shown in FIGS. 14 to 18, upon comparison with the timepiece 2 with the calendar mechanism 1 shown in FIGS. 1 to 13, the same elements are given the same reference numerals, and corresponding but different elements are given the corresponding reference numerals with the subscript A.

Figure 14:
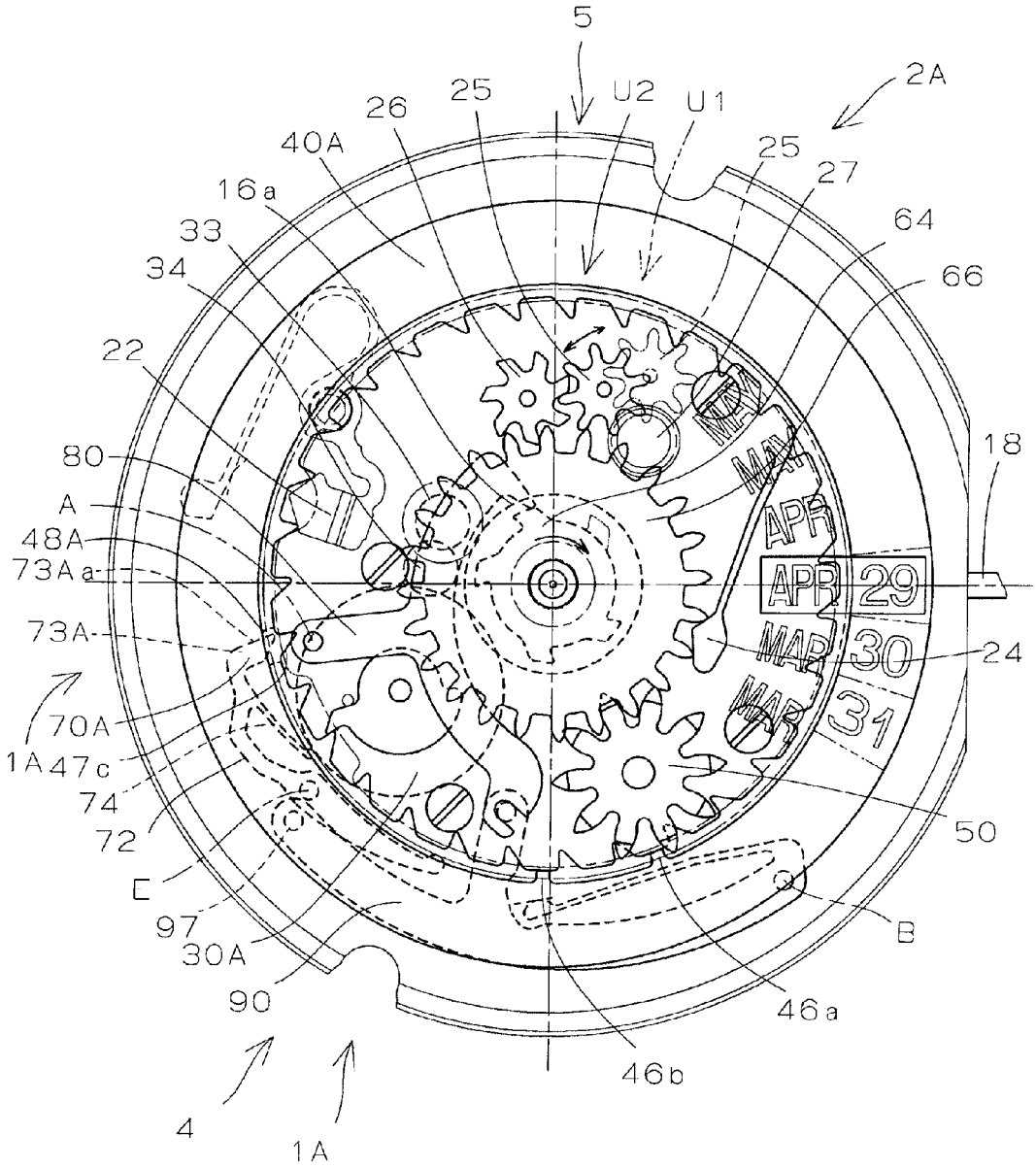
FIG. 14 is a plan view which is the same as FIG. 2 and shows a timepiece with calendar mechanism according to another preferred embodiment of the present invention having an automatic calendar mechanism according to another preferred embodiment of the present invention.
Figure 15:
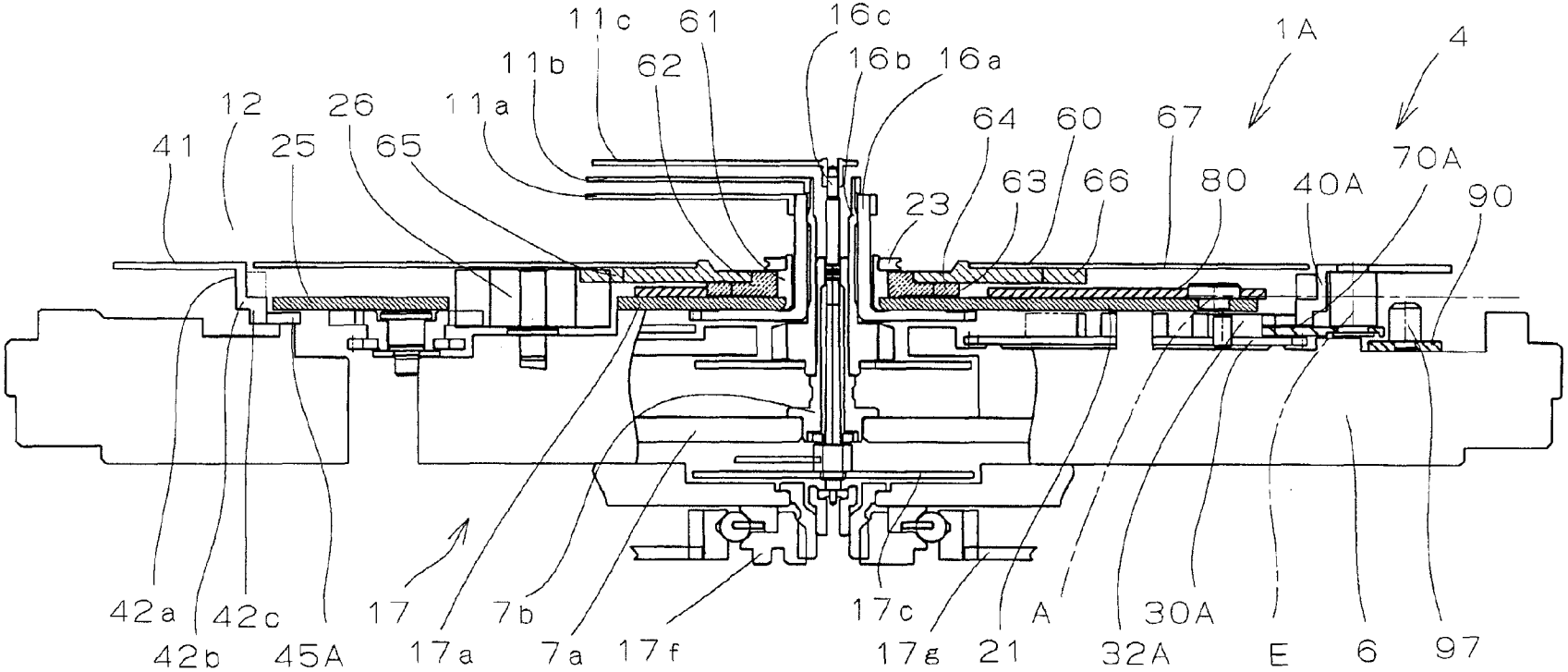
FIG. 15 is a cross-sectional view which is the same as FIG. 4 and shows the timepiece with calendar mechanism having the automatic calendar mechanism shown in FIG. 14.

The automatic calendar mechanism 1A of the timepiece 2A, for example, as shown in FIGS. 14 and 15, includes a notched portion 48A at the case back side surface of the tooth 47*c* and a small-diameter and thick cylindrical portion 42*c*A at a position in the circumferential direction where a date wheel portion 45A of a date indicator 40A overlaps the tooth 47*c* to be fed to 31-st date by a robust date finger 32A. In addition, the date finger 32A may have an arm portion which can be elastically bent in the same manner as the date finger 32 of the automatic calendar mechanism 1 of the timepiece 2.

In addition, in the automatic calendar mechanism 1A of the timepiece 2A, as shown in FIG. 14, an operation lever 70A includes the arm portion 72 attached to the date indicator 40A and a spring portion 74 such that a tooth-shaped engaged portion 73A can be rotated at a position in the circumferential direction where it is fitted to the notched portion 48A at which the tooth 47*c* is located. The tooth-shaped engaged portion 73A is formed to be long such that the front end portion 73A thereof is projected inward in the diameter direction more than the front end portion of the tooth 47*c* when inserted into the notched portion 48A.

In other configurations, the automatic calendar mechanism 1A of the timepiece 2A is formed in the same manner as the automatic calendar mechanism 1 of the timepiece 2 in practice.

The automatic calendar mechanism 1A of the timepiece with calendar mechanism 2A according to another preferred embodiment of the present invention having the above-described configuration performs the following operation at the end of the month of the short month.

Figure 16:
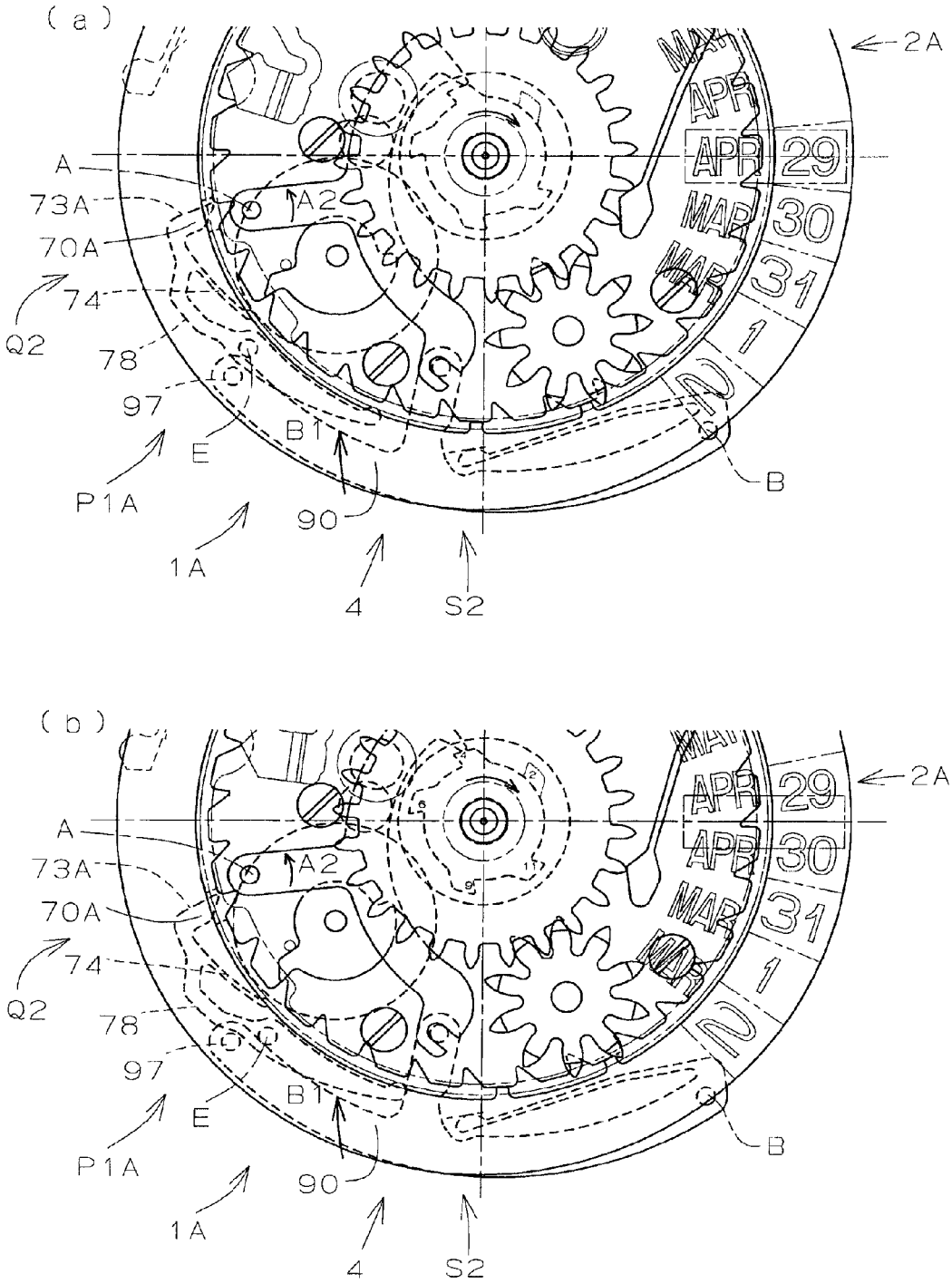
FIG. 16 shows a state where the timepiece shown in FIG. 14 indicates April 29, wherein (a) is a plan view which is the same as FIG. 14 before a date change (changing in date indication) from April 29 to the next day is started, and (b) is a plan view which is the same as FIG. 14 immediately before a date change from April 29 to the next day is started.

(a) of FIG. 16 shows a state corresponding to (a) of FIG. 7 regarding the automatic calendar mechanism 1 of the timepiece with calendar mechanism 2 according to the first embodiment, and shows a state immediately before date changing starts, for example, April 29 to April 30. In this state, the first and second driving levers 80 and 90 constituting the driving lever structure 4 are respectively located at the short month positions Q2 and S2, but the operation lever 70A is still located at the retreat position P1A as a normal feed allowing position.

(b) of FIG. 16 shows a state corresponding to (b) of FIG. 7 regarding the automatic calendar mechanism 1, and shows a state where date changing, for example, from April 29 to April 30 is in progress. In this state as well, the first and second driving levers 80 and 90 constituting the driving lever structure 4 are respectively located at the short month positions Q2 and S2, but the operation lever 70A is still located at the retreat position P1A as a normal feed allowing position.

In this state, since the second driving lever 90 of the driving lever structure 4 is set to the short month position S2, and the pin-shaped pressing portion 97 enters the C2 direction rotation trajectory of the operation lever 70 in the B1 direction, when the outer surface 78 of the operation lever 70A reaches the pin-shaped pressing portion 97 part by the C2 direction rotation of the date indicator 40A, the operation lever 70A is pressed by the pin-shaped pressing portion 97 in the E1 direction, and thereby the tooth-shaped engaged portion 73A of the operation lever 70A can be projected inward in the diameter direction through the notched portion 48A.

Figure 17:
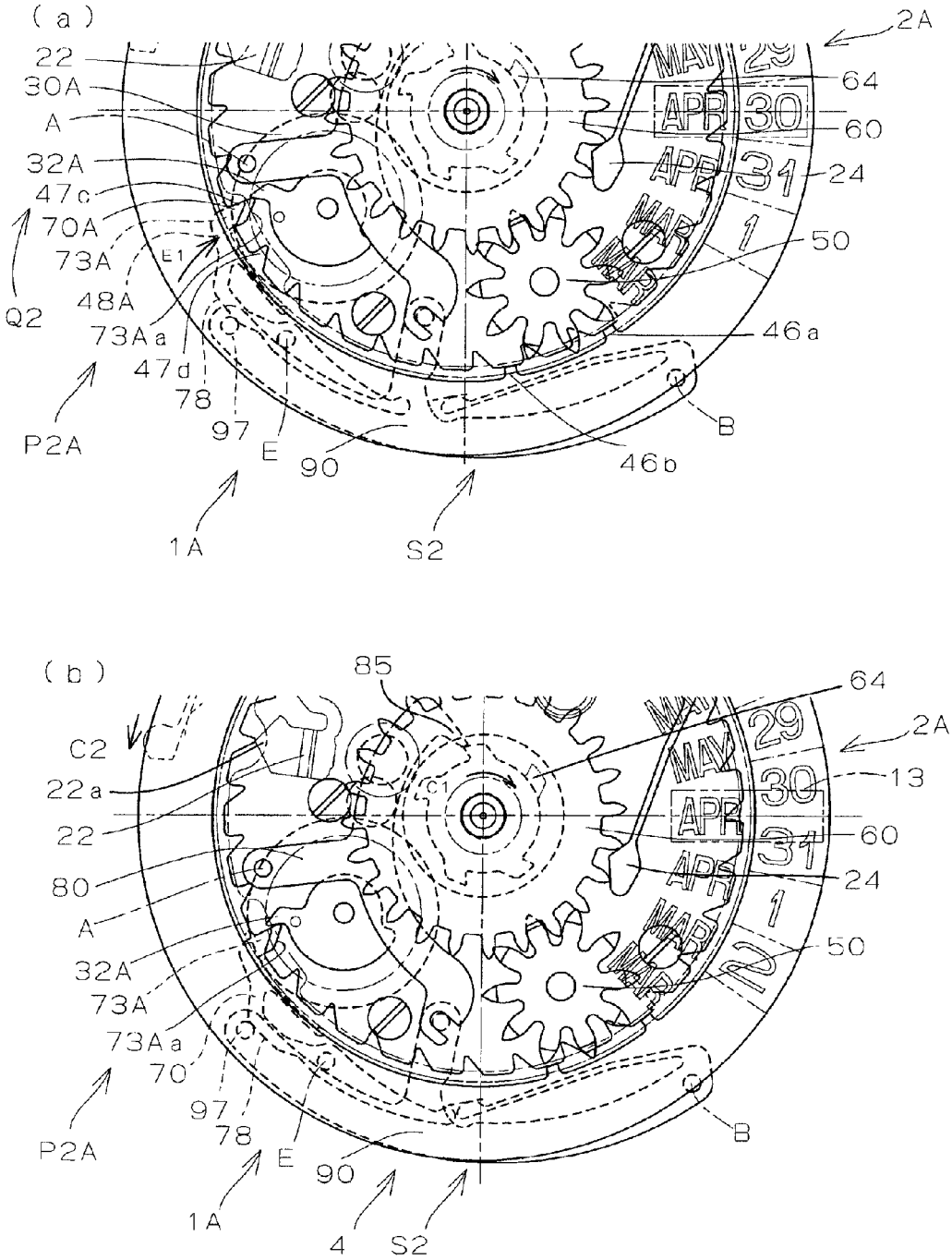
FIG. 17 shows a state where the timepiece shown in FIG. 14 indicates April 30, wherein (a) is a plan view which is the same as FIG. 14 before a date change (changing in date indication) from April 30 to the next day is started, and (b) is a plan view which is the same as FIG. 14 and shows an intermediate state where a first change of two changes of the date indication from April 30 to the next day is in progress.

(a) of FIG. 17 shows a state of the calendar mechanism 1A of the timepiece 2A when date feeding from April 30 to the next day starts. At this time point, the operation lever 70A is pressed by the pin-shaped pressing portion 97 in the E1 direction, and the tooth-shaped engaged portion 73A of the operation lever 70A is inserted into the notched portion 48A and is set to a position P2A as a pre-feed allowing position where the front end portion 73Aa thereof is greater than the tooth 47*c* located at the overlapping position and is projected inward in the diameter direction. Therefore, the date finger 32A of the date indicator driving wheel 30A is engaged with the front end portion 73Aa of the tooth-shaped engaged portion 73A which is greatly projected at a position of the tooth portion 47*c* located by one tooth further on the upstream side than the tooth portion 47*d* which is located at an original feeding position, and starts to feed it in the C2 direction. This state substantially corresponds to the state shown in (b) of FIG. 8 regarding the calendar mechanism 1 of the timepiece 2. However, feeding start time is, for example, around 19:00 (7 o' clock p.m.) in this example, and is earlier than the case of (b) of FIG. 8 by about 2.5 hours.

Thereafter, the C2 direction rotation of the date indicator 40A or the date feeding proceeds by the front end portion 73Aa of the tooth-shaped engaged portion 73A according to the rotation of the date indicator driving wheel 30A due to the rotation of the hour wheel & pinion 16*a*, which leads to a state immediately before the date jumper 22 jumps as shown in (b) of FIG. 17. This is an exactly intermediate state of date feeding corresponding to one day (date feeding from "30-th date" to "31-st date") of date feeding corresponding to two days performed in transition to 1-st date of a long month (in this example, May) at the 30-th date which is an end date of the short month (in this example, April), and substantially corresponds to the state shown in (a) of FIG. 9 regarding the calendar mechanism 1 of the timepiece 2.

Next, the date jumper 22 jumps and falls between the adjacent teeth 47 and 47, and thereby a setting operation is performed. At this time, the date wheel portion 45A of the date indicator 40A is substantially rotated by a half pitch in the C2 direction, which leads to a state shown in (a) of FIG. 18 in which "31" is displayed in the date indication region 13*b* of the month and date indication window 13. This state substantially corresponds to the state shown in (b) of FIG. 10 regarding the calendar mechanism 1 of the timepiece 2 (however, a position of the date indicator driving wheel 40A is slightly different from the position of the date indicator driving wheel 40 of (b) of FIG. 10 as described above in relation to (a) of FIG. 17).

In this state, since the retreated (recessed) outer surface portion 78*a* of the outer surface 78 of the operation lever 70A comes into contact with the pin-shaped pressing portion 97 of the second driving lever 90, under the action of the spring portion 74, the operation lever 70A is rotated and retreats in the E2 direction from the position P2A as a pre-feed allowing position where the tooth-shaped engaged portion 73A is projected through the notched portion 48A to the position P1A as a normal feed allowing position where it is pulled on the front side of the notched portion 48A. On the other hand, the date wheel portion 45A is rotated by a half pitch in the C2 direction, and thereby the tooth portion 47*c* at which the notched portion 48A is located precedes the date finger 32A of the date indicator driving wheel 30A and is settled in a position to be fed next.

Figure 18:
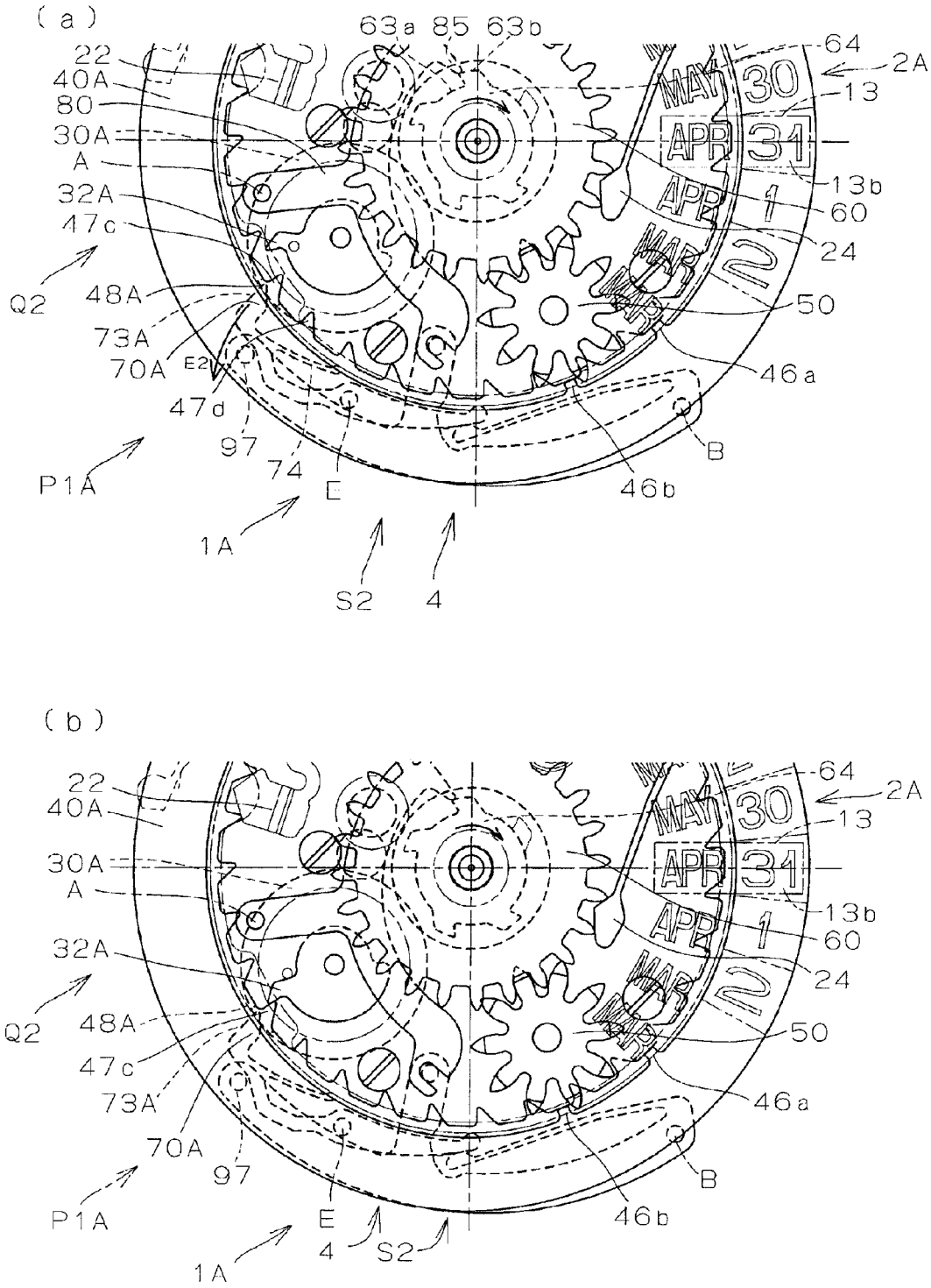
FIG. 18 shows an intermediate state where the timepiece shown in FIG. 14 is being changed from April 30 to May 1, wherein (a) is a plan view which is the same as FIG. 14 and shows a state where the first change of the two changes in the date indication from April 30 to May 1 is completed, and (b) is a plan view which is the same as FIG. 14 and shows a state where preparation for a second change of the two changes in the date indication from April 30 to May 1 is completed.

Thereafter, according to the rotation of the date indicator driving wheel 30A due to the rotation of the hour wheel & pinion 16*a*, as shown in (b) of FIG. 18, the date finger 32A is engaged with the tooth 47*c* located at the date feed position so as to start to feed the tooth 47*c*, and the month feed tooth 46*b* on the rear side of the date indicator 40A rotates the month indicator 60 via the month transmission wheel 50, thereby starting month feeding. Thereby, the date indication in the date indication region 13*b* of the month and date indication window 13 is changed from "31-st" date to "1-st" date, and, at the same time, the month indication in the month indication region 13*a* is changed from "April (APR)" to "May (MAY)". This substantially corresponds to the state shown in (a) of FIG. 11 regarding the calendar mechanism 1 of the timepiece 2. In the short month, an operation thereafter is the same as in the case of the calendar mechanism 1 of the timepiece 2.

In addition, in a long month, since the cam follower portion 85 comes into contact with the small-diameter arc-shaped cam face 63*a* of the month cam 64, the long month positions Q1 and S1 are selected at which the first and second driving levers 80 and 90 of the driving lever structure 4 are respectively rotated in the A1 and B2 directions, and the pin-shaped pressing portion 97 is completely deviated from the C2 direction rotation trajectory of the operation lever 70A. Therefore, since the operation lever 70A is also normally rotated in the E2 direction and takes the position P1A as a normal feed allowing position where the tooth-shaped engaged portion 73A completely retreats from the notched portion 48A, the date finger 32A of the date indicator driving wheel 30A sequentially feeds thirty-one tooth portions 47 of the date wheel portion 45A, which is the same as in the case of the calendar mechanism 1 of the timepiece 2. An operation of transition from a long month to a short month is basically the same as in the case of the calendar mechanism 1 of the timepiece 2.

FIGS. 19 to 23 show a timepiece having an automatic calendar mechanism 1B as a calendar mechanism according to another preferred embodiment of the present invention, that is, a timepiece with calendar mechanism 2B. In the timepiece 2B with the calendar mechanism 1B shown in FIGS. 19 to 23, upon comparison with the timepiece 2 with the calendar mechanism 1 shown in FIGS. 1 to 13 OR the timepiece 2A with the calendar mechanism 1A shown in FIGS. 14 to 18, the same elements are given the same reference numerals, and corresponding but different elements are given the corresponding reference numerals with the subscript B (however, in a case of presence of A in the last, A is excluded).

Figure 19:
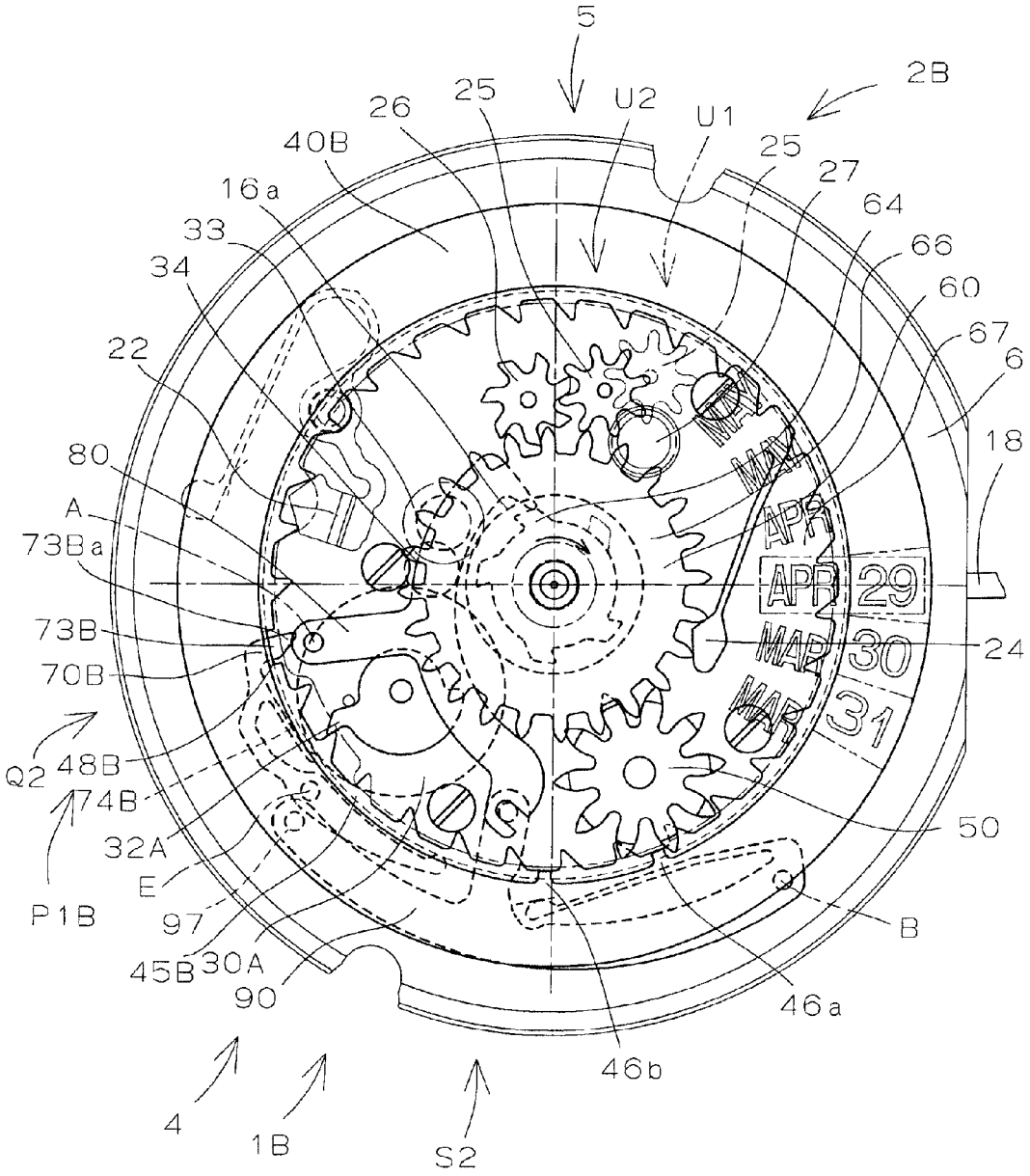
FIG. 19 is a plan view which is the same as FIG. 2 or FIG. 14 and shows a timepiece with calendar mechanism according to still another preferred embodiment of the present invention having an automatic calendar mechanism according to still another preferred embodiment of the present invention.

In the automatic calendar mechanism 1B of the timepiece 2B, for example, as shown in FIG. 19, a tooth at a part where a date wheel portion 45B of a date indicator 40B is to be fed to 31-st date by the robust date finger 32A is omitted, and a notched portion 48B is formed at the part (circumferential direction region) in the same manner as the case of the automatic calendar mechanism 1A of the timepiece 2A shown in FIG. 14 or the like. In this case as well, the date finger 32A may have an arm portion which can be elastically bent in the same manner as the date finger 32 of the automatic calendar mechanism 1 of the timepiece 2.

Figure 20:
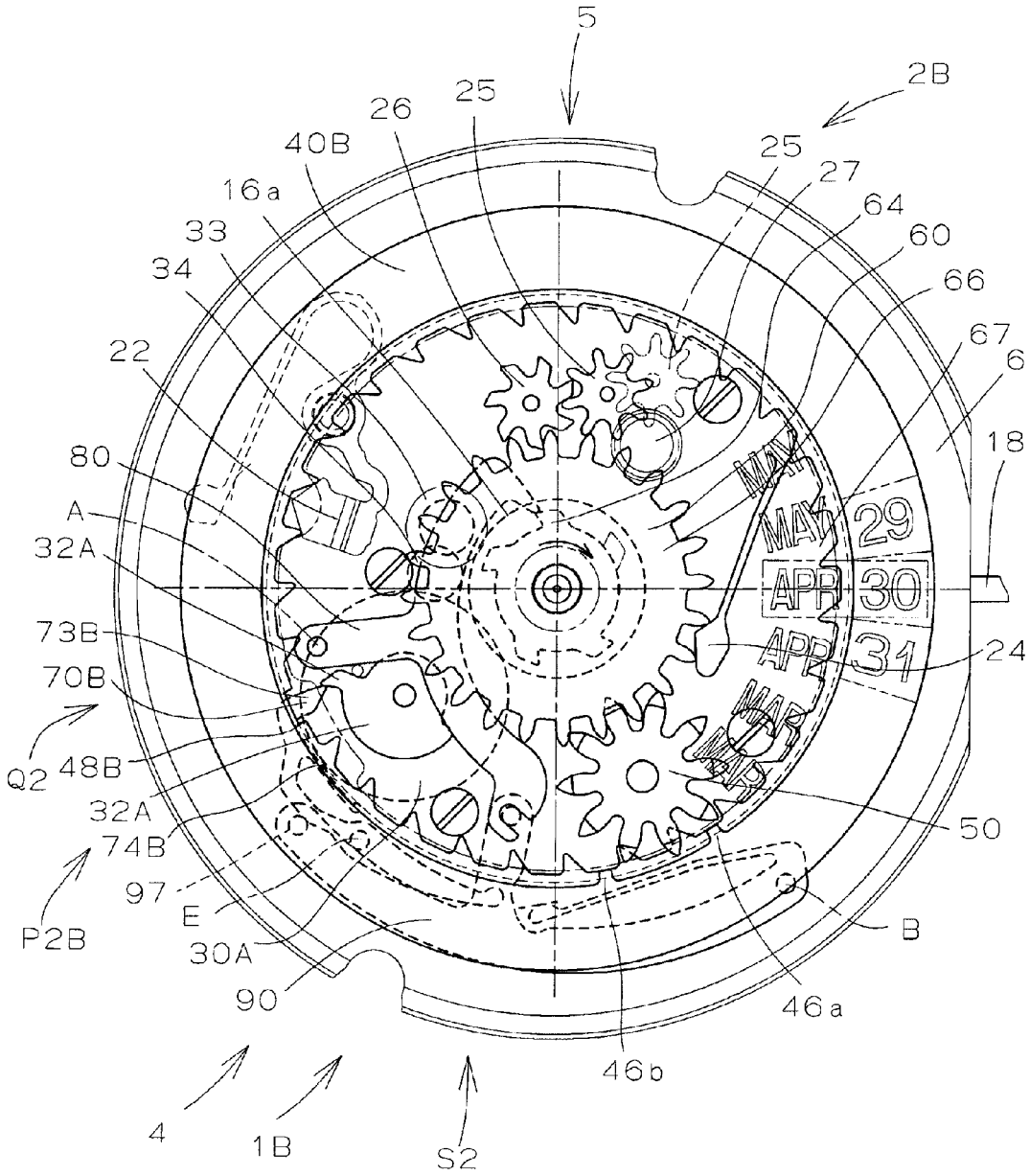
FIG. 20 is a plan view which is the same as FIG. 19 and shows a state where the timepiece indicates April 30, and before a date change from April 30 to the next day (changing in the date indication).
Figure 21:
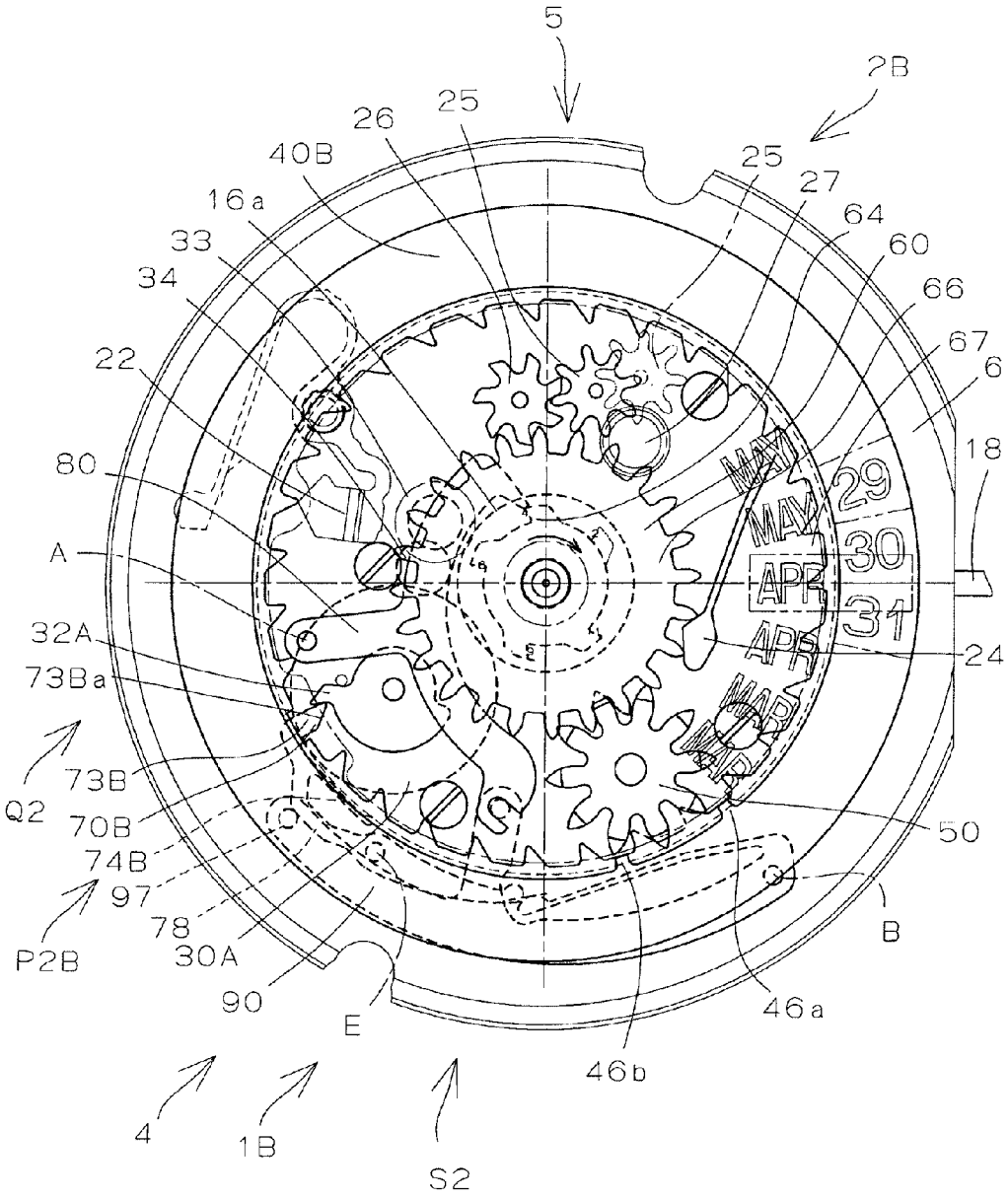
FIG. 21 is a plan view which is the same as FIG. 19 and shows an intermediate state where a first change of two changes of the date indication from April 30 to May 1 is in progress.

In addition, in the automatic calendar mechanism 1B of the timepiece 2B, as shown in FIG. 20 or 21, in a case where the operation lever 70B is pressed by the pin-shaped pressing portion 97 of the second driving lever 90 of the driving lever structure 4 at the outer surface 78 and thus takes a position P2B as a pre-feed allowing position where it is rotated in the E1 direction, the tooth-shaped engaged portion 73B is provided so as to be projected inward in the diameter direction more than the typical teeth 47 of the date wheel portion 45B in the same manner as the case of the operation lever 70A.

Figure 22:
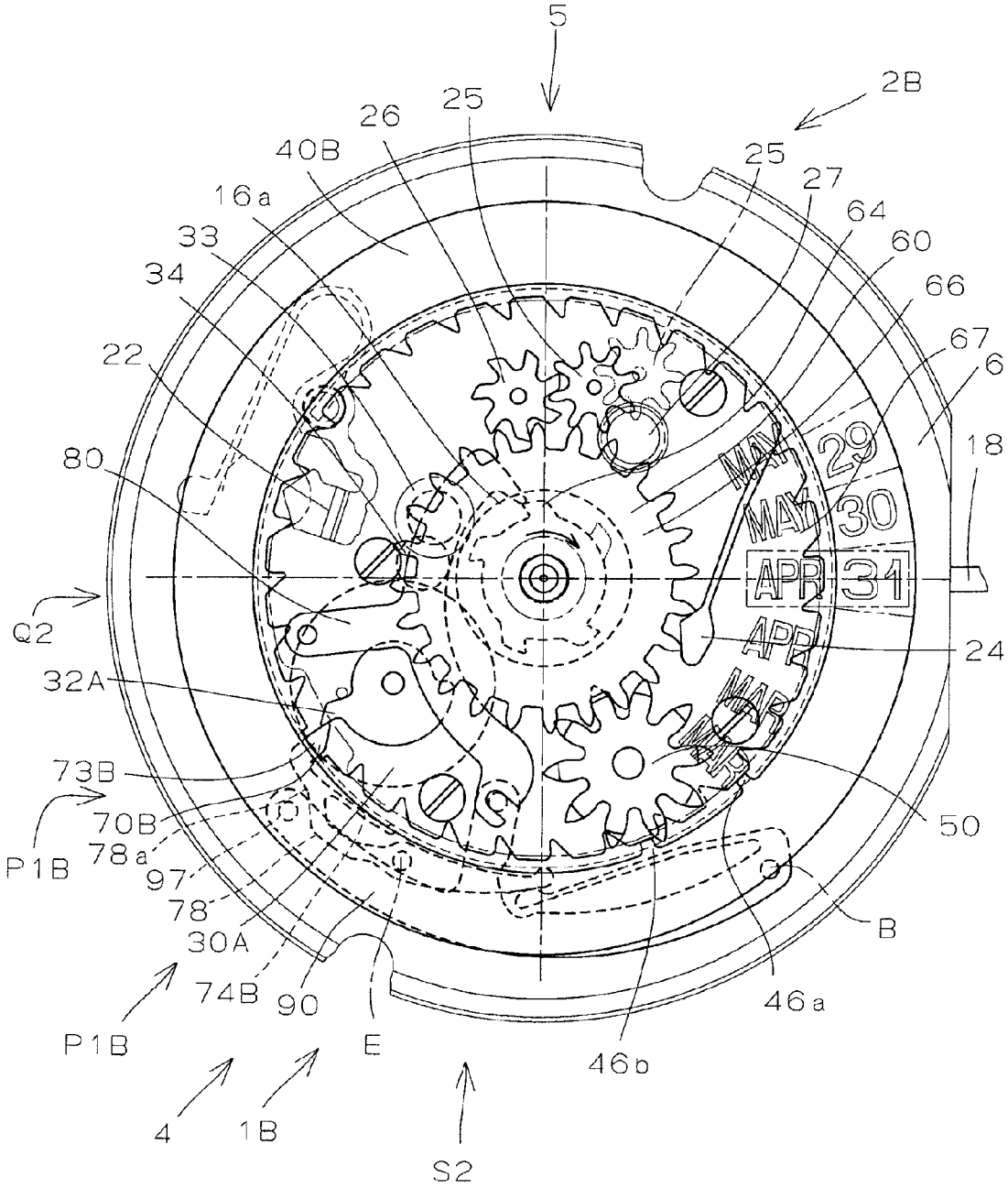
FIG. 22 is a plan view which is the same as FIG. 19 and shows a state where the first change of the two changes in the date indication from April 30 to May 1 is completed.
Figure 23:
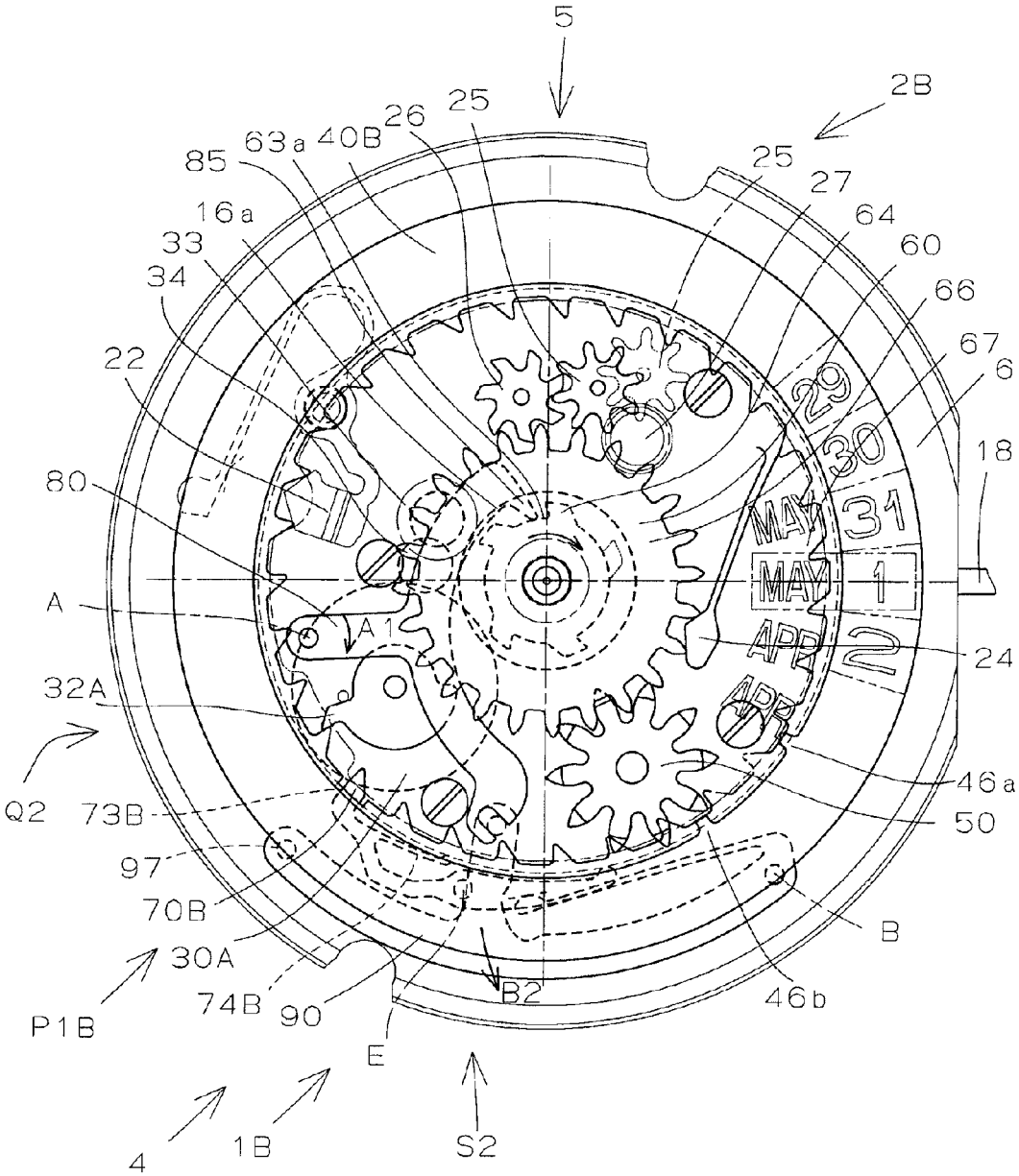
FIG. 23 is a plan view which is the same as FIG. 19 and shows a state where the second change of the two changes in the date indication from April 30 to May 1 is completed.

In the operation lever 70B of the automatic calendar mechanism 1B, in a case where the pin-shaped pressing portion 97 of the second driving lever 90 of the driving lever structure 4 retreats outward in the diameter direction in a region which does not come into contact with the outer surface portion 78, unlike in the operation lever 70A of the automatic calendar mechanism 1A, as shown in FIG. 22 or 23, the tooth-shaped engaged portion 73B or the spring portion 74B is formed such that the tooth-shaped engaged portion 73B takes a state of being projected inward in the diameter direction from the notched portion 48B up to the diameter direction position which is exactly the same as the typical teeth 47 of the date wheel portion 45B.

In other configurations, the automatic calendar mechanism 1B of the timepiece 2B is formed in the same manner as the automatic calendar mechanism 1A of the timepiece 2A or the automatic calendar mechanism 1 of the timepiece 2 in practice.

The automatic calendar mechanism 1B of the timepiece with calendar mechanism 2B according to still another preferred embodiment of the present invention having the above-described configuration performs the following operation at the end of the month of the short month.

FIG. 19 corresponds to (a) of FIG. 7 regarding the automatic calendar mechanism 1 of the timepiece with calendar mechanism 2, shows a state correspond to the state shown in (a) of FIG. 16 regarding the automatic calendar mechanism 1A of the timepiece with calendar mechanism 2A, and shows a state immediately before date changing starts, for example, April 29 to April 30. In this state, the first and second driving levers 80 and 90 constituting the driving lever structure 4 are respectively located at the short month positions Q2 and S2, but the operation lever 70A is still located at the retreat position P1B as a normal feed allowing position.

In this state, date feeding is performed to reach "30-th" date. At this time, the outer surface 78 of the operation lever 70B presses the pin-shaped pressing portion 97 of the second driving lever 90 located at the position S2, thereby the operation lever 70B is rotated in the E1 direction so as to be set to the position P2B as a pre-feed allowing position, and thus the tooth-shaped engaged portion 73B of the operation lever 70B is greatly projected inward in the diameter direction through the notched portion 48B of the date wheel portion 45B of the date indicator 40B.

FIG. 20 shows a state where the date finger 32A comes into contact with the front end portion 73Ba of the tooth-shaped engaged portion 73B which is greatly projected of the operation lever 70B by the rotation of the date indicator driving wheel 30A according to the rotation of the hour wheel & pinion 16*a* in the 30-th date state and starts to feed a date. This state corresponds to the state shown in (a) of FIG. 17 regarding the automatic calendar mechanism 1A of the timepiece with calendar mechanism 2A (therefore, substantially the state shown in (b) of FIG. 8 regarding the automatic calendar mechanism 1 of the timepiece with calendar mechanism 2). That is to say, the date finger 32A of the date indicator driving wheel 30A is engaged with the front end portion 73Ba of the tooth-shaped engaged portion 73B which is greatly projected at a position in the circumferential direction located by one tooth further on the upstream side than the tooth portion 47*d* which is located at an original feeding position, and starts to feed it in the C2 direction. This feeding start time is, for example, around 19:00 (7 o' clock p.m.) in this example, and is earlier than the case of (b) of FIG. 8 by about 2.5 hours in the same as the case of the automatic calendar mechanism 1A of the timepiece with calendar mechanism 2A.

Thereafter, the C2 direction rotation of the date indicator 40A or the date feeding proceeds by the front end portion 73Ba of the tooth-shaped engaged portion 73B according to the rotation of the date indicator driving wheel 30A due to the rotation of the hour wheel & pinion 16*a*, which leads to a state shown in FIG. 21 (immediately before the date jumper 22 jumps) in the same manner as shown in (b) of FIG. 17 regarding the automatic calendar mechanism 1A of the timepiece with calendar mechanism 2A. This is an exactly intermediate state of date feeding corresponding to one day (date feeding from "30-th date" to "31-st date") of date feeding corresponding to two days performed in transition to 1-st date of a long month (in this example, May) at the 30-th date which is an end date of the short month (in this example, April), and substantially corresponds to the state shown in (a) of FIG. 9 regarding the calendar mechanism 1 of the timepiece 2.

Next, the date jumper 22 jumps and falls between the adjacent teeth 47 and 47, thereby a setting operation is performed, and, the date wheel portion 45B of the date indicator 40B is substantially rotated by a half pitch in the C2 direction, which leads "31" to be displayed in the date indication region 13*b* of the month and date indication window 13. In this state, since the retreated (recessed) outer surface portion 78*a* of the outer surface 78 of the operation lever 70B faces the pin-shaped pressing portion 97 of the second driving lever 90 and thus does not come into contact with the pin-shaped pressing portion 97, under the action of the spring portion 74, the front end portion 73Ba of the tooth-shaped engaged portion 73B of the operation lever 70B is practically located at the same projection position in the diameter direction as the typical teeth 47 of the date wheel portion 45B. On the other hand, the date wheel portion 45B is rotated by a half pitch in the C2 direction, and thereby the tooth-shaped engaged portion 73B which takes practically the same projection state as the typical teeth 47 at the notched portion 488 precedes the date finger 32A of the date indicator driving wheel 30A and is settled in a position to be fed next.

Thereafter, according to the rotation of the date indicator driving wheel 30A due to the rotation of the hour wheel & pinion 16*a*, as shown in FIG. 22, the date finger 32A is engaged with the tooth 73B located at the date feed position so as to start to feed the tooth 73B, and the month feed tooth 46*b* on the rear side of the date indicator 40B rotates the month indicator 60 via the month transmission wheel 50, thereby starting month feeding. Thereby, the date indication in the date indication region 13*b* of the month and date indication window 13 is changed from "31-st" date to "1-st" date, and, at the same time, the month indication in the month indication region 13*a* is changed from "April (APR)" to "May (MAY)". This substantially corresponds to the state shown in (b) of FIG. 18 regarding the calendar mechanism 1A of the timepiece 2A or the state shown in (a) of FIG. 11 regarding the calendar mechanism 1 of the timepiece 2. In the short month, an operation thereafter is the same as in the case of the calendar mechanism 1A of the timepiece 2A or in the case of the calendar mechanism 1 of the timepiece 2.

In addition, in a long month, since the cam follower portion 85 comes into contact with the small-diameter arc-shaped cam face 63*a* of the month cam 64, the long month positions Q1 and S1 are selected at which the first and second driving levers 80 and 90 of the driving lever structure 4 are respectively rotated in the A1 and B2 directions, and the pin-shaped pressing portion 97 is completely deviated from the C2 direction rotation trajectory of the operation lever 70B. Therefore, since the operation lever 70B is also normally rotated in the E2 direction and takes the position P1B as a normal feed allowing position where the tooth-shaped engaged portion 73B is projected from the notched portion 48B to the same extent as the typical teeth 47, the date finger 32A of the date indicator driving wheel 30A feeds the tooth-shaped engaged portion 73B in the same manner as thirty tooth portions 47 of the date wheel portion 45B, which is resultantly the same as in the case of the calendar mechanism 1A of the timepiece 2A or the calendar mechanism 1 of the timepiece 2. An operation of transition from a long month to a short month is also basically the same as in the case of the calendar mechanism 1A of the timepiece 2A or the calendar mechanism 1 of the timepiece 2.

What is claimed is:

1. A calendar mechanism comprising:

a date indicator that includes a date wheel portion provided with a notched portion extending in a diameter direction;

an operation lever that is attached to the date indicator so as to be pivoted with respect to a date wheel and is provided at one end with a tooth-shaped engaged portion and can progress and retreat to and from the notched portion formed at the date indicator when pivoted, wherein the operation lever can be pivoted between a pre-feed allowing position where the tooth-shaped engaged portion is deeply inserted into the notched portion and is engaged with a date finger, and thereby excess feeding of the date indicator is possible, and a normal feed allowing position where the tooth-shaped engaged portion retreats further from the notched portion than the pre-feed allowing position and thus normal feeding is possible by the date finger, and the date finger is engaged with the tooth-shaped engaged portion before the timing of the normal feeding and rotates the date indicator by an excess day earlier than the normal feeding when set to the pre-feed allowing position;

a month cam that is rotated according to rotation of a month indication wheel and has a cam face indicating long months and short months; and a driving lever structure that includes a cam follower engaged with the month cam and is driven in response to rotation of the month cam so as to allow the operation lever to be pivoted between the normal feed allowing position and the pre-feed allowing position, wherein the driving lever structure allows the operation lever to be displaced to the pre-feed allowing position when a month is changed from the short month to the long month.

2. The calendar mechanism according to claim 1, wherein the date wheel includes a notched portion between adjacent tooth portions, wherein the operation lever can be pivoted between a pre-feed allowing position where the tooth-shaped engaged portion enters the notched portion and a normal feed allowing position where the tooth-shaped engaged portion retreats from the notched portion and becomes distant from the date finger, and thereby normal feeding is possible, and wherein, when a month is changed from the short month to the long month, the operation lever takes the pre-feed allowing position where the tooth-shaped engaged portion enters the notched portion, and the date finger is engaged with the tooth-shaped engaged portion before the timing of the normal feeding and rotates the date indicator by an excess day earlier than the normal feeding.

3. The calendar mechanism according to claim 2, wherein, when the operation lever takes the pre-feed allowing position, the tooth-shaped engaged portion is projected inward in the diameter direction to the same extent as a tooth portion forming the date wheel, and when the operation lever takes the normal feed allowing position, the tooth-shaped engaged portion retreats outward in the diameter direction from the notched portion so as to be located further outward in the diameter direction than the tooth portion forming the date wheel.

4. The calendar mechanism according to claim 1, wherein the date wheel includes a groove-shaped notched portion that radially extends along one tooth portion at a position in the circumferential direction which overlaps one tooth portion, and wherein, when a month is changed from the short month to the long month, the tooth-shaped engaged portion of the operation lever enters the groove-shaped notched portion, and the date indicator is rotated with a spare by a day.

5. The calendar mechanism according to claim 4, wherein, when the operation lever takes the pre-feed allowing position, the tooth-shaped engaged portion is projected further inward in the diameter direction than the tooth portion forming the date wheel, and when the operation lever takes the normal feed allowing position, the tooth-shaped engaged portion retreats outward in the diameter direction from the notched portion so as to be located further outward in the diameter direction than the tooth portion forming the date wheel.

6. The calendar mechanism according to claim 1, wherein one tooth portion of thirty-one tooth portions which are disposed at the same interval and form the date wheel is omitted so as to form the notched portion, and wherein, when a month is changed from the short month to the long month, the tooth-shaped engaged portion of the operation lever enters the groove-shaped notched portion, and the date indicator is rotated with a spare by a day.

7. The calendar mechanism according to claim 6, wherein, when the operation lever takes the pre-feed allowing position, the tooth-shaped engaged portion is projected further inward in the diameter direction than the tooth portions forming the date wheel, and when the operation lever takes the normal feed allowing position, the tooth-shaped engaged portion retreats outward in the diameter direction from the notched portion as compared with the case of being located at the pre-feed allowing position so as to be projected inward in the diameter direction to the same extent as the tooth portions forming the date wheel.

8. The calendar mechanism according to claim 1, wherein the driving lever structure includes a first driving lever that is rotated by the month cam, and a second driving lever that is rotated by the rotation of the first driving lever and controls pivoting of the operation lever.

9. The calendar mechanism according to claim 1, wherein the operation lever is configured to enter the pre-feed allowing position when time reaches an end of the month at a pivot position where the operation lever takes in the short month such that the operation lever takes the pre-feed allowing position at the end of the month of the short month, and the tooth-shaped engaged portion of the operation lever enters the notched portion.

10. A timepiece with calendar mechanism comprising the calendar mechanism according to claim 1.

* * * * *